US010330447B2

(12) United States Patent
Burczynski

(10) Patent No.: US 10,330,447 B2
(45) Date of Patent: Jun. 25, 2019

(54) PROJECTILE WITH CORE-LOCKING FEATURES AND METHOD OF MANUFACTURING

(71) Applicant: Sig Sauer, Inc., Newington, NH (US)

(72) Inventor: Thomas J. Burczynski, Montour Falls, NY (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/023,545

(22) Filed: Jun. 29, 2018

(65) Prior Publication Data

US 2019/0017789 A1 Jan. 17, 2019

Related U.S. Application Data

(60) Provisional application No. 62/532,069, filed on Jul. 13, 2017.

(51) Int. Cl.

| | |
|---|---|
| ***F42B 12/34*** | (2006.01) |
| ***F42B 12/78*** | (2006.01) |
| ***F42B 12/74*** | (2006.01) |
| *F42B 33/02* | (2006.01) |

(52) U.S. Cl.

CPC ..... *F42B 12/34* (2013.01); *F42B 12/74* (2013.01); *F42B 12/78* (2013.01); *F42B 33/02* (2013.01)

(58) Field of Classification Search

CPC ..... F42B 12/78; F42B 12/74; F42B 12/34
USPC ..... 102/506–510, 516, 514, 518, 501, 439, 102/464, 515; 86/55
See application file for complete search history.

(56) References Cited

U.S. PATENT DOCUMENTS

| | | | | |
|---|---|---|---|---|
| 219,840 | A | 9/1879 | Winchester | |
| 376,302 | A | 1/1888 | Gregg | |
| 481,081 | A * | 8/1892 | Tweedie | F42B 12/34 102/509 |
| 594,199 | A | 11/1897 | Field | |
| 1,059,213 | A | 4/1913 | Charles | |
| 1,080,974 | A | 12/1913 | Johnson | |
| 1,084,343 | A | 1/1914 | Johnson | |
| 1,095,501 | A | 5/1914 | Hoagland | |
| 1,135,357 | A | 4/1915 | Clyne | |
| 1,475,578 | A | 11/1923 | Hadfield et al. | |
| 1,556,160 | A | 10/1925 | Riggs | |
| 1,633,168 | A | 6/1927 | Dickerman | |
| 1,681,295 | A | 8/1928 | Johnson | |

(Continued)

FOREIGN PATENT DOCUMENTS

EP 2012083 B1 * 5/2012 ..... F42B 5/025

OTHER PUBLICATIONS

Hornady website page, InterLock bullet (Jun. 27, 2017).

*Primary Examiner* — Reginald S Tillman, Jr.
(74) *Attorney, Agent, or Firm* — Finch & Maloney PLLC

(57) ABSTRACT

A firearm projectile has a core extending along a central axis from a base portion to a tip portion, the base portion generally having a cylindrical shape and the tip portion comprising an ogive shape. A jacket encases the core along the base portion and the tip portion, the jacket having a shank portion defining a closed rear end and an ogive portion extending to an open front end. Protrusions extend into the core from an inside of the shank portion, the protrusions having a spaced-apart arrangement with each protrusion engaging the core to retain the core together with the jacket upon impact with a target.

21 Claims, 21 Drawing Sheets

(56) References Cited

U.S. PATENT DOCUMENTS

| | | | | |
|---|---|---|---|---|
| 1,715,788 | A | 6/1929 | Rousseu | |
| 1,730,871 | A | 10/1929 | Aronson | |
| 1,833,127 | A | 11/1931 | Rinkel | |
| 2,045,964 | A | 6/1936 | Rinkel | |
| 2,123,981 | A | 7/1938 | Whipple | |
| 2,327,950 | A | 8/1943 | Whipple | |
| 2,765,738 | A | 10/1956 | Frech | |
| 2,838,000 | A | 6/1958 | Schreiber | |
| 2,982,550 | A | 5/1961 | Francis | |
| 3,003,420 | A | 10/1961 | Nosler | |
| 3,120,188 | A | 2/1964 | Kreuzer | |
| 3,143,966 | A * | 8/1964 | Burns, Jr. | F42B 12/34 102/507 |
| 3,157,137 | A | 11/1964 | Burns, Jr. | |
| 3,165,809 | A | 1/1965 | Burns et al. | |
| 3,311,962 | A | 4/1967 | Burns, Jr. | |
| 3,349,711 | A | 10/1967 | Julius et al. | |
| 3,431,612 | A | 3/1969 | Julius et al. | |
| 3,881,421 | A | 5/1975 | Burczynski | |
| 4,044,685 | A | 8/1977 | Avcin | |
| 4,069,586 | A | 1/1978 | Skelton | |
| 4,193,348 | A | 3/1980 | Halverson | |
| 4,245,557 | A | 1/1981 | Knappworst et al. | |
| 4,336,756 | A | 6/1982 | Schreiber | |
| 4,352,225 | A * | 10/1982 | Schreiber | B21K 1/025 29/511 |
| 4,387,492 | A | 6/1983 | Inman | |
| 4,550,662 | A | 11/1985 | Burczynski | |
| 4,610,061 | A | 9/1986 | Halverson | |
| 4,655,140 | A | 4/1987 | Schirneker | |
| D294,000 | S | 2/1988 | Friedrich | |
| 4,776,279 | A | 10/1988 | Pejsa | |
| 4,819,563 | A | 4/1989 | Bodet | |
| 4,829,906 | A | 5/1989 | Kaswer | |
| 4,836,110 | A | 6/1989 | Burczynski | |
| 4,856,160 | A | 8/1989 | Habbe et al. | |
| 4,882,822 | A | 11/1989 | Burczynski | |
| 4,947,755 | A | 8/1990 | Burczynski | |
| 5,079,814 | A | 1/1992 | Moore et al. | |
| 5,101,732 | A | 4/1992 | Schluckebier | |
| 5,131,123 | A | 7/1992 | Brooks | |
| 5,208,424 | A | 5/1993 | Schluckebier | |
| 5,259,320 | A | 11/1993 | Brooks | |
| 5,357,866 | A | 10/1994 | Schluckebier et al. | |
| D363,335 | S | 10/1995 | Dixon | |
| 5,528,990 | A | 6/1996 | Corzine et al. | |
| D371,302 | S | 7/1996 | Spirer | |
| D374,802 | S | 10/1996 | Spirer et al. | |
| 5,641,937 | A | 6/1997 | Carter | |
| 5,811,723 | A | 9/1998 | Stone | |
| 6,178,890 | B1 | 1/2001 | Burczynski et al. | |
| 6,257,149 | B1 | 7/2001 | Cesaroni | |
| 6,305,292 | B1 | 10/2001 | Burczynski et al. | |
| D452,894 | S | 1/2002 | Benini | |
| 6,530,328 | B2 | 3/2003 | Burczynski et al. | |
| D482,252 | S | 11/2003 | Hyde | |
| 6,805,057 | B2 | 10/2004 | Carr et al. | |
| D511,003 | S | 10/2005 | Sliwa, Jr. | |
| D518,178 | S | 3/2006 | Tom | |
| D561,543 | S | 2/2008 | Andrew | |
| 7,360,491 | B2 | 4/2008 | Sanborn | |
| D603,045 | S | 10/2009 | Petersen | |
| 7,658,137 | B1 * | 2/2010 | Romero | F42B 7/10 102/502 |
| D626,619 | S | 11/2010 | Frank et al. | |
| D632,357 | S | 2/2011 | Dixon | |
| D654,591 | S | 2/2012 | Finn | |
| 8,141,494 | B2 * | 3/2012 | Riess | F42B 12/74 102/501 |
| 8,307,768 | B2 | 11/2012 | Cziglenyi | |
| D694,788 | S | 12/2013 | Carper | |
| D715,888 | S | 10/2014 | Charles | |
| D719,590 | S | 12/2014 | Johnston | |
| D726,281 | S | 4/2015 | Powers, Jr. | |
| D727,126 | S | 4/2015 | Spencer | |
| D737,874 | S | 9/2015 | Powers, Jr. | |
| 9,188,414 | B2 | 11/2015 | Burczynski | |
| 9,341,455 | B2 | 5/2016 | Fricke | |
| 9,534,876 | B2 | 1/2017 | Silvers | |
| 9,631,910 | B2 | 4/2017 | Fricke | |
| 10,041,773 | B2 * | 8/2018 | Peterson | F42B 12/74 |
| 2007/0079721 | A1 | 4/2007 | Webb | |

* cited by examiner

Section B-B

Section A-A

160
C
D
D
C 66
96
65
64
61
66
64
65
W 15
96
95
94
61
T1
T2
93
60
65
82
80
78
Section C-C 15
96
95
94
82b
T1
65
T2
66
93
60
82
80
78
Section D-D

PROJECTILE WITH CORE-LOCKING FEATURES AND METHOD OF MANUFACTURING

RELATED APPLICATIONS

This application claims priority under 35 U.S.C. § 119(e) to U.S. Provisional Patent Application No. 62/532,069 titled PROJECTILE WITH CORE-LOCKING FEATURES AND METHOD OF MANUFACTURING THE PROJECTILE, and filed on Jul. 13, 2017, the contents of which are incorporated herein by reference in its entirety

FIELD OF THE DISCLOSURE

The present disclosure relates to firearm ammunition, and more particularly to an expanding projectile with features to retain the core together with the jacket on impact with a target and a method of manufacturing the same.

BACKGROUND

Firearms, such as rifles and pistols, can be used for hunting, law enforcement, and self-defense. A firearm is configured to fire or otherwise launch a projectile (e.g., a bullet) towards a target or object located within an area. The projectile is designed to travel through the air and impact the target located a distance away from a shooter's position. Before firing, the projectile is held in the mouth of a cartridge casing that contains a propellant (e.g., gunpowder) and includes a primer. Upon activating a trigger assembly of the firearm, a firing pin of the firearm strikes the primer to ignite the propellant and launch the projectile through the barrel of the firearm. With respect to game-hunting, one goal of the projectile is to expand or mushroom on impact while retaining the core within its jacket.

SUMMARY OF THE DISCLOSURE

Embodiments of the present disclosure relate generally to an expanding or mushrooming projectile having a malleable core disposed within a jacket formed from a malleable material. Embodiments of the present disclosure also relate to a method of making an expanding projectile.

One aspect of the present disclosure is directed to an expanding firearm projectile comprising a malleable core and a jacket. In one embodiment, a firearm projectile has a core extending along a central axis from a base portion to a tip portion, the base portion generally having a cylindrical shape and the tip portion comprising an ogive shape. A jacket encases the core along the base portion and the tip portion, the jacket having a shank portion defining a closed rear end and an ogive portion extending to an open front end. A plurality of protrusions extends into the core from an inside of the shank portion, the plurality of protrusions having a spaced-apart arrangement with each of the plurality of protrusions engaging the core to retain the core together with the jacket upon impact with a target.

In some embodiments, the shank portion has a rear sidewall portion with a rear sidewall thickness and a forward sidewall portion with a forward sidewall thickness less than the rear sidewall thickness. For example, the rear sidewall thickness is from 1.5 to 3.0 times the forward sidewall thickness, including 2.0, 2.25, 2.5, and 2.75 times the forward sidewall thickness. In some such embodiments, each of the protrusions extends from the shank portion between the rear sidewall portion and the forward sidewall portion.

In some embodiments, the core comprises a first metal and the jacket comprises a second metal, the first material being more malleable than the second metal. Examples of metals for the core include lead, a lead alloy, a lead-antimony alloy, tin, and a tin alloy. Examples of jacket metal include copper, brass, and gilding metals. In one embodiment, the core comprises a lead-antimony alloy containing antimony in an amount from 0.25 percent to 6.0 percent by weight. In another embodiment, the core comprises a tin alloy containing tin in an amount from 90 percent to 99 percent by weight.

In some embodiments, some or all of the protrusions have a circumferential width along the inside of the shank portion that is greater than a circumferential width of a gap between adjacent ones of the plurality of protrusions along the inside of the shank portion.

In some embodiments, the plurality of protrusions includes a first protrusion positioned opposite the central axis from a second protrusion. In other embodiments, the plurality of protrusions includes at least three protrusions evenly distributed about the central axis. In some embodiments, each of the plurality of protrusions extends into the core along a protrusion axis defining a locking angle with an adjacent inside surface of the shank portion forward of the plurality of protrusions, the locking angle from 45° to 120°.

In one such embodiment, the locking angle is from 85° to 95°. In another embodiment, the locking angle is greater than 90°. In yet another embodiment, the locking angle is from 60° to 120°.

In some embodiments, each of the protrusions extends into the core a distance from 0.015" to 0.100".

In some embodiments, the ogive portion has a tangent ogive shape. In other embodiments, the ogive portion has a secant ogive shape.

In some embodiments, the tip portion of the core protrudes from the open front end of the jacket and defines a rounded tip continuous with an outer surface of the jacket. For example, the projectile is configured as a soft-point projectile.

In some embodiments, the tip portion of the core defines a cavity recessed from the open front end of the jacket. For example, the projectile is configured as a hollow-point projectile. In other embodiments, the projectile includes a tip insert having a tip shank portion extending axially into the cavity through the open front end of the jacket, and having a tip portion seated against the open front end. For example, the tip insert comprises a polymer.

In some embodiments, the firearm projectile is an expanding projectile. Any of the embodiments of the projectile may include a cartridge casing with a mouth, where the projectile is retained in the mouth of the cartridge casing.

Another aspect of the present disclosure is directed to a method of manufacturing an expanding firearm projectile. In one embodiment, the method includes providing a cylindrical pre-form of metal and having a sidewall extending along a central axis from a closed rear end to an open front end, where the sidewall has a rear sidewall portion with a rear sidewall thickness, a forward sidewall portion with a forward sidewall thickness less than the rear sidewall thickness, and a shoulder between the rear sidewall portion and the forward sidewall portion; forming a plurality of core-locking protrusions in the cylindrical pre-form to provide a processed jacket, the plurality of core-locking protrusions circumferentially spaced and extending generally towards the open front end from a forward portion of the rear sidewall portion; providing a core of malleable material, the core having a first core portion with a first diameter, a neck portion with a neck diameter smaller than the first diameter, and a core shoulder between the first core portion and the neck portion; placing the core in the processed jacket with the neck portion extending towards the rear end through a space defined radially between the plurality of core-locking protrusions and with the core shoulder disposed in contact with ends of the plurality of core-locking protrusions; seating the core in the processed jacket to provide a cylindrical pre-form, thereby bending each of the plurality of core-locking protrusions radially inward and embedding the plurality of core-locking protrusions into the rearward core portion; and forming the cylindrical pre-form into a projectile with a jacket encasing the core except at an open front end, where the projectile has a shank portion with a cylindrical shape and an ogive portion with an ogival shape extending forward from the shank portion to a projectile tip.

In some embodiments, forming the plurality of core-locking protrusions is performed by axially impacting and penetrating the shoulder and a forward portion of the rear sidewall portion of the jacket pre-form. For example, the shoulder is axially impacted and penetrated with a cylindrical, multi-bladed dividing punch.

In some embodiments, forming the plurality of core-locking protrusions includes forming the plurality of core-locking protrusions extending forward along a protrusion axis defining an angle from 15° to 45° with respect to an adjacent inside surface of the forward sidewall portion.

In some embodiments, seating the core in the processed jacket includes axially compressing the core, thereby displacing air between the core and the processed jacket with the core.

In some embodiments, forming the cylindrical pre-form into the projectile is performed by forcing the cylindrical pre-form into an ogival-shaped die.

In some embodiments, seating the core in the processed jacket causes each of the plurality of core-locking protrusions to define a core-locking angle from 60° to 120° with respect to an adjacent inside surface of the forward sidewall portion. In some embodiments, seating the core in the processed jacket causes each of the plurality of core-locking protrusions to extend into the rearward core portion with the core-locking angle from 85° to 95°. In other embodiments, seating the core in the processed jacket causes each of the plurality of core-locking protrusions to extend into the rearward core portion with the core-locking angle greater than 90°.

In some embodiments, forming the plurality of core-locking protrusions includes defining at least some of the plurality of core-locking protrusions to span a protrusion sector about the central axis that is greater than a gap sector of a gap between adjacent core-locking protrusions.

In some embodiments, forming the plurality of core-locking protrusions includes defining a first core-locking protrusion positioned opposite the central axis from a second core-locking protrusion.

In some embodiments, forming the plurality of core-locking protrusions includes defining at least three core-locking protrusions evenly distributed about the central axis.

In some embodiments, forming the cylindrical pre-form includes forming the rear sidewall thickness to be from 2.0 to 2.75 times the forward sidewall thickness.

In some embodiments, seating the core in the processed jacket causes each of the plurality of core-locking members to extend into the core a distance from 0.015" to 0.100".

In some embodiments, the malleable material is selected from lead, a lead alloy, a lead-antimony alloy, tin, or a tin alloy. In some embodiments, the malleable material is a lead-antimony alloy containing antimony in an amount from 0.25 percent to 6.0 percent by weight. In another embodiment, the malleable material is a tin alloy containing tin in an amount from 90 percent to 99 percent by weight.

In another embodiment, forming the cylindrical pre-form into the projectile includes forming the ogive portion to have a tangent ogive shape or a secant ogive shape.

In another embodiment, forming part of the forward sidewall portion into an ogival shape causes the core to protrude from the open front end and define a rounded tip with exposed malleable material that is continuous with an outer surface of the ogive portion.

In another embodiment, the method includes defining a hollow-point cavity recessed from the open front end.

In another embodiment, the method includes defining a recess in the core adjacent the open front end, providing a tip insert having a tip stem portion and a tip portion, and installing the tip insert in the recess with the tip stem portion extending into the core through the open front end and the tip portion seated against the open front end of the jacket. In some embodiments, the projectile tip is selected to be made of a polymer.

Additional features of the present disclosure exist and will be described hereinafter and which will form the subject matter of the attached claims. These and various other advantages, features, and aspects of the embodiments will become apparent and more readily appreciated from the following detailed description of the embodiments taken in conjunction with the accompanying drawings.

DETAILED DESCRIPTION

Figure 1:
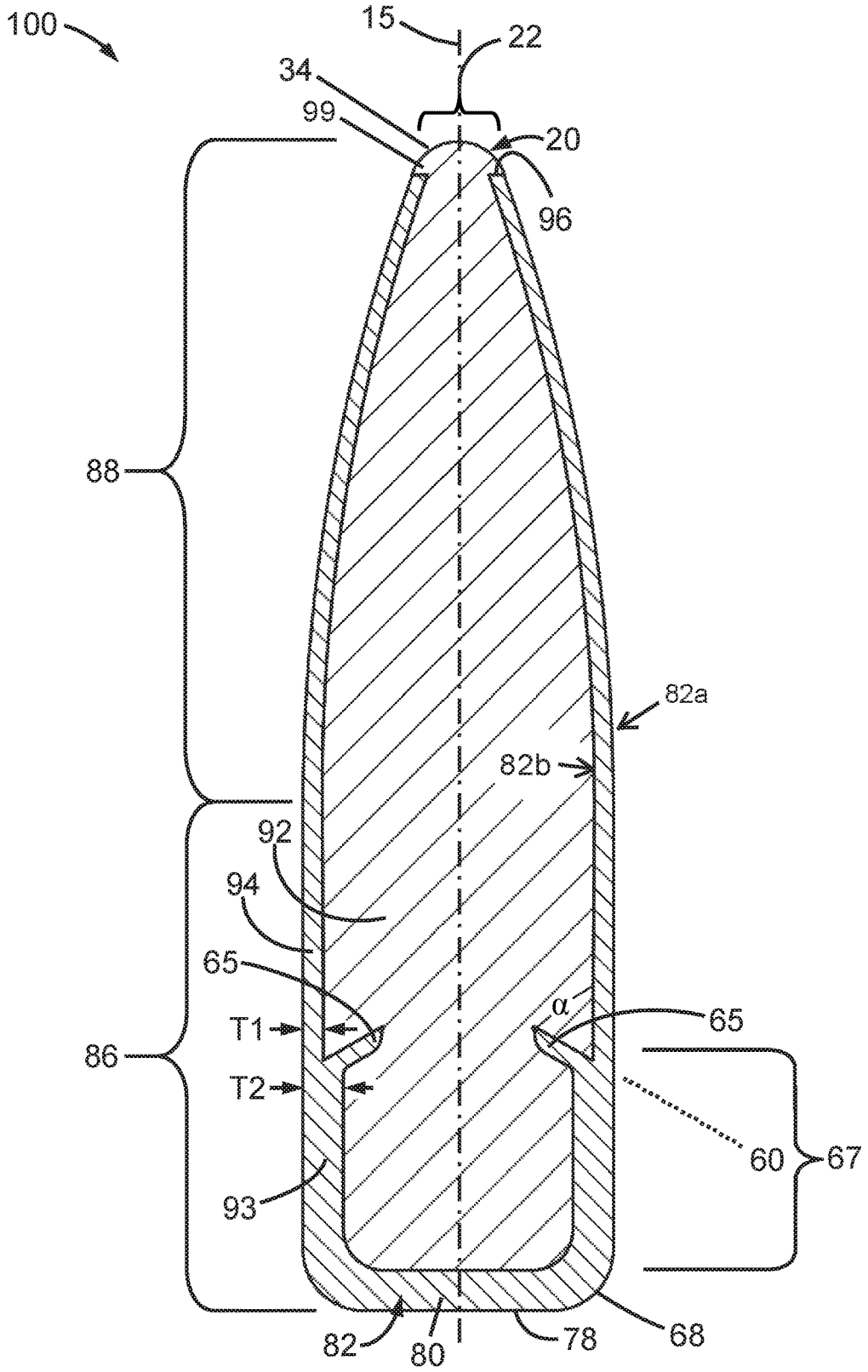
FIG. 1 is a longitudinal cross-sectional view of a profiled projectile oriented vertically, shown with a soft point tip, and including core-locking protrusions embedded in the core at a locking angle of 60 degrees, in accordance with an embodiment of the present disclosure.

The present disclosure is generally directed to embodiments of an expanding projectile useful in hunting, law enforcement, and personal protection, and a method of making the projectile. In accordance with some embodiments of the present disclosure, a jacketed projectile prevents or greatly reduces jacket-core separation by providing a jacket with a plurality of core-locking protrusions extending from the inside jacket wall into a projectile core. The core-locking protrusions are embedded into the projectile core at a locking angle defined relative to the adjacent jacket wall. For example, the locking angle is from 30° to 120°, such as 30°, 60°, 90°, or 120°.

General Overview

For a projectile to achieve optimum terminal performance, it is desirable that its jacket and core penetrate a target as a single unit and remain connected throughout the course of travel, regardless of the resistance offered by the target material.

Various attempts have been made over the years to form projectiles where the projectile's jacket and core remain coupled together on impact. One of the earliest and simplest attempts utilized a knurling process to create a cannelure in a jacketed projectile. A cannelure typically includes a narrow, 360-degree circumferential depression in the shank portion of the projectile jacket. The cannelure originally was conceived to serve as a crimping feature, where the mouth or rim of the cartridge case is mechanically forced radially inward into the cannelure to secure the projectile in the cartridge case. Various manufacturers have since attempted to use the cannelure as a crimping groove and a core-retaining feature, or simply a core-retaining feature.

The knurling process typically utilizes a multi-tooth knurling wheel that cuts into the jacket and forces the jacket material radially inward into the core. The result is a shallow annular rim that extends a short distance into the projectile core. Due to this process, the jacket wall can often be weakened circumferentially in both the fore and aft areas of the cannelure. This weakness deficit is evidenced in the U.S. Military's M193 rifle projectile, where the projectile breaks into two pieces at the cannelure during target impact as the projectile loses stability and begins to tumble or gyrate around its own axis.

The cannelure approach has also proven to be ineffective in keeping the core and jacket together upon impact with a target, such as a game animal. Upon impact, the core tends to immediately extrude beyond the confines of the shallow rim-like protrusion extending into the cannelure and subsequently slides completely out of the jacket. Depending on jacket wall thickness, core hardness, impact energy, and especially on the inertial forces that develop on impact, axial core movement can actually smooth the internal geometry of the cannelure to a degree that allows the core to slide forward. In addition, when impacting hard barriers, the jacket can crack and/or be severed circumferentially along the inherently weakened, fore and aft boundaries of the cannelure. Such a failure can result in jacket-core separation and a concurrent loss in projectile mass and momentum, thereby reducing target penetration. Even the use of multiple cannelures have proven ineffective in retaining the core with the jacket due to the shallow depth of each cannelure and the inadequate amount of area the cannelures collectively occupy.

U.S. Pat. No. 4,336,756 (Schreiber) describes a bullet intended for hunting. The Schreiber bullet has a jacket utilizing a cannelure plus an annular ledge on the inside surface of the jacket with an inwardly-extending ring of jacket material terminating in a knife-like edge to engage the core. The annular ledge is spaced from the base portion of the jacket. The ledge is formed with blunt upper and lower punches moving in opposite directions to cause the metal at a ledge in the jacket to flow inwardly and form an annular ridge.

One shortcoming associated with the Schreiber approach is the limited radial width of the annular ring of jacket material. Accordingly, the ring does not extend sufficiently into the projectile core and therefore cannot provide adequate core-holding ability. In order to retain the core together with the jacket on impact with a target, the circular ring depends on the additional assistance of a cannelure. The combination of the ring and the cannelure is required to ensure the core and the jacket remain locked during expansion. Attempts to increase the radial width of the ring cause the heel of the jacket to become sharpened as the heel collapses axially and flattens. This outcome is undesirable because it degrades projectile accuracy. Also, increasing the axially-directed force to gather more jacket material and increase the ring's radial distance results in cracks along the ring's circumference.

U.S. Pat. No. 4,856,160 (Habbe, et al.) describes a bullet with a tubular jacket having a reverse taper. The jacket wall is thicker at the intermediate portion than either the heel or mouth portions to define a reverse taper along the intermediate and heel portions. The reverse taper bulges inwardly at the intermediate portion compared to the heel portion interior. The reverse taper provides an inside diameter at the jacket intermediate portion that is less than at the jacket heel portion and in such manner produces a constriction that interlocks the lead core and jacket together.

The downside to the Habbe, et al. approach is that the reverse taper portion of the jacket has a shallow angle which does not grip the core in an aggressive manner and therefore allows the core to slip on impact. Like the Schreiber bullet, the failure to securely grip the core is why a roll crimp (or "bullet knurl") is also required to retain the core within the jacket upon impact with a target.

U.S. Pat. No. 9,188,414 (Burczynski) describes a reduced-friction expanding bullet with an improved core retention feature. The cylindrical jacket is forced into a die to create at the same time a wide-area circumferential indentation and an ogival bullet nose. The circumferential indentation is formed as a wide-area radiused depression that contacts the core and serves as a living hinge to facilitate flexing and bending of portions of the ogive as the ogive impacts a target and expands.

A challenge of the Burczynski approach is that thick-wall jacketed pre-forms can be difficult to collapse during manufacture, therefore limiting the materials used to produce the jacket and increasing the cost of manufacture.

Other attempts at retaining the core together with the jacket after impact with a target have been used in the past. Such attempts include (1) providing a partition within the jacket that separates a rear core from a front core, (2) electroplating a copper skin around the core prior to final forming of the projectile, and (3) heat-bonding the core to the interior of the jacket wall after the projectile is final-formed. These additional methods can have one or more shortcomings that include jacket-core eccentricity that results in reduced accuracy in flight due to projectile imbalance. Another shortcoming is limited or insufficient core-holding ability. Further shortcomings are slower manufacturing rates, high or increased manufacturing costs, and/or lower reliability.

In light of the aforementioned shortcomings, a need exists for a new and improved expanding projectile with superior core-retaining ability without sacrificing projectile performance. The various embodiments of the present disclosure fulfill this need.

Example Projectile Configurations

FIG. 1 illustrates a longitudinal cross-sectional view of a projectile 100 shown in an upright orientation, in accordance with an embodiment of the present disclosure. Projectile 100 is fully formed and includes a hollow jacket 82 surrounding a malleable core 92 disposed in the jacket 82. In some embodiments, the core 92 is made of lead or a lead alloy. Other materials with a malleability greater than that of pure copper are acceptable for core 92. As shown in FIG. 1, projectile 100 is configured as a jacketed soft point (JSP) projectile suitable for rifle cartridges, where the projectile tip 20 is an exposed extension of the core 92. Projectile 100 of FIG. 1 includes features common to other embodiments discussed below and shown, for example, in FIGS. 2-5 and FIGS. 22 and 23.

Projectile 100 has a generally cylindrical shape that is rotationally symmetrical about a central axis 15. The projectile 100 extends from a rear end 78 to a forward terminus 34 of the projectile tip 20, which can be an extension of the core 92 as shown in FIG. 1. The projectile 100 has an outside surface 82*a* defined along the jacket 82 and the projectile tip 20. Projectile tip 20 may be defined by the core 92 extending through the open front end 99 as shown for example in FIG. 1, by the front end 99 of the jacket 82 (e.g., a hollow-point projectile tip 20), or by a tip insert 30, depending on whether the projectile 100 has a soft point configuration, a hollow point configuration, a polymer tip configuration, or some other configuration. The projectile 100 has a cylindrical shank 86 that includes a closed rear end 78, a rear sidewall 93, and part of a forward sidewall 94. Shank 86 continues forward to an ogive portion 88 that includes part of forward sidewall extending to an open front end 99. The ogive portion 88 has a gentle curve toward the meplat 22 of the projectile tip 20. In some embodiments, the projectile 100 has a flat rear end 78 that transitions to the rear sidewall 93 with a rounded heel 68. For improved projectile accuracy, the rounded heel 68 can have a relatively large radial width approximate to that of jacket 82 overall.

The jacket 82 is hollow with an outside surface 82*a* and an inside surface 82*b*. Jacket 82 has a base portion 80, a rear sidewall 93, and a forward sidewall 94 that extends from rear sidewall 93 to open front end 99. The rear sidewall 93 connects to and extends between the base portion 80 and the forward sidewall 94. The forward sidewall 94 extends forward from the rear sidewall 93 and along the ogive portion 88 to an open front end 99 with rim a 96. In some embodiments, jacket 82 is formed of copper, a copper alloy, cupronickel, steel, brass, gilding metal, or other metal. In general, jacket 82 is made of a material (e.g., copper alloy or other metal) that is harder and less malleable than core 92 (e.g., a lead alloy). Other materials with comparable malleability are acceptable depending on the intended use of projectile 100.

In some embodiments, jacket 82 has two distinct wall thicknesses: a rear sidewall thickness T2 is thicker than a forward sidewall thickness T1. The difference in wall thickness ultimately depends on the projectile type and its intended use. In some embodiments, for example, jacket 82 has a wall thickness ratio of 2:1, where the rear sidewall thickness T2 is about twice as thick as the forward sidewall thickness T1. In other embodiments, jacket 82 has a different value of the wall thickness ratio, such as embodiments in which projectile 100 is heavy and/or a high velocity projectile that develops high inertial forces on impact. In such embodiments, the rear sidewall thickness T2 can be as much as 2.75 times thicker than the forward sidewall thickness T1. The wall thickness may transition abruptly or gradually from rear sidewall thickness T2 to forward sidewall thickness T1.

Jacket 82 defines a plurality of circumferentially-spaced core-locking protrusions 65 that extend radially inward from inside surface 82*b* of rear sidewall 93 adjacent forward sidewall 94. In some embodiments, core-locking protrusions 65 (or simply "protrusions") are evenly spaced in a circular pattern along the inside surface 82*b* of the jacket 82. For example, portions of the thicker rear wall 93 adjacent the forward sidewall 94 are formed into a plurality of core-locking protrusions 65 arranged in a circular pattern and extending longitudinally and radially inward towards the central axis 15 of the projectile 100. The jacket 82 can include two or more core-locking protrusions 65. One example embodiment has four core-locking protrusions 65. Core-locking protrusions can be evenly distributed circumferentially about central axis 15, but this is not required so long as projectile 100 is balanced, as will be appreciated. The thickness of each core-locking protrusion 65 depends on the rear sidewall thickness T2. As the rear sidewall thickness T2 increases for a given forward sidewall thickness T1, core-locking protrusions 65 can be thicker, stiffer, and more robust. In example embodiments, one or more of the core-locking protrusion 65 has an elongated shape similar to a spike or tooth, where the cross-sectional shape of the core-locking protrusion 65 is square or rectangular. In other embodiments, one or more of the core-locking protrusions 65 have a wedge shape extending from about 10-90° along the circumference of the sidewall, including 20°, 30°, 40°, 50°, 60°, 70°, and 80°. The core-locking protrusions 65 can be radially embedded into a rear portion of the core 92 to a depth between about 0.015" and 0.100", depending on projectile caliber, weight and type.

When core-locking protrusions 65 are initially formed from rear sidewall 93, they generally extend in a forward direction and slightly away from inside surface 82*b* of forward sidewall 94. Core-locking protrusions 65 shown in FIG. 1 have been bent rearwardly from their initial position to a final locking angle α as a result of a process used to seat the core 92 in a pre-form version of the jacket 82. Accordingly, each core-locking protrusion 65 shown in FIG. 1 defines a locking angle α of about 60 degrees with respect to forward sidewall 94. In the finished projectile 100 as shown, for example, in FIG. 1, core-locking protrusions 65 are embedded in core 92 with each core-locking protrusion 65 surrounded by and contacting the core 92. In some embodiments, locking angle α is in a range from 60° to 120° as defined between a protrusion axis 60 and forward sidewall 94. Any value of locking angle α within that range is acceptable. In other embodiments, locking angle α can be less than 60° or greater than 120°. Specific locking angles α may serve specific purposes with respect to various projectiles 100. Regardless of the locking angle α, a locking chamber 67 is defined between the base 80, the rear jacket wall 93, and the core-locking protrusions 65.

While a tangent ogive is shown in FIG. 1 (as well as the projectile examples shown in FIGS. 2-5 and FIGS. 22 and 23), projectiles 100 made in accordance with some embodiments of the present disclosure can utilize either a tangent ogive or a secant ogive. A secant ogive has the potential to increase the ballistic coefficient of the projectile due to a more pointed and streamlined profile. For example, the secant ogive shape is advantageous for extremely long-range shooting since the projectile retains a higher velocity at long distances. It is also contemplated that while a flat base 80 is shown in FIGS. 1-5, 22 and 23, base 80 can have a "boat tail" shape (e.g., a frustocone or taper) for an improved ballistic coefficient.

Figure 2:
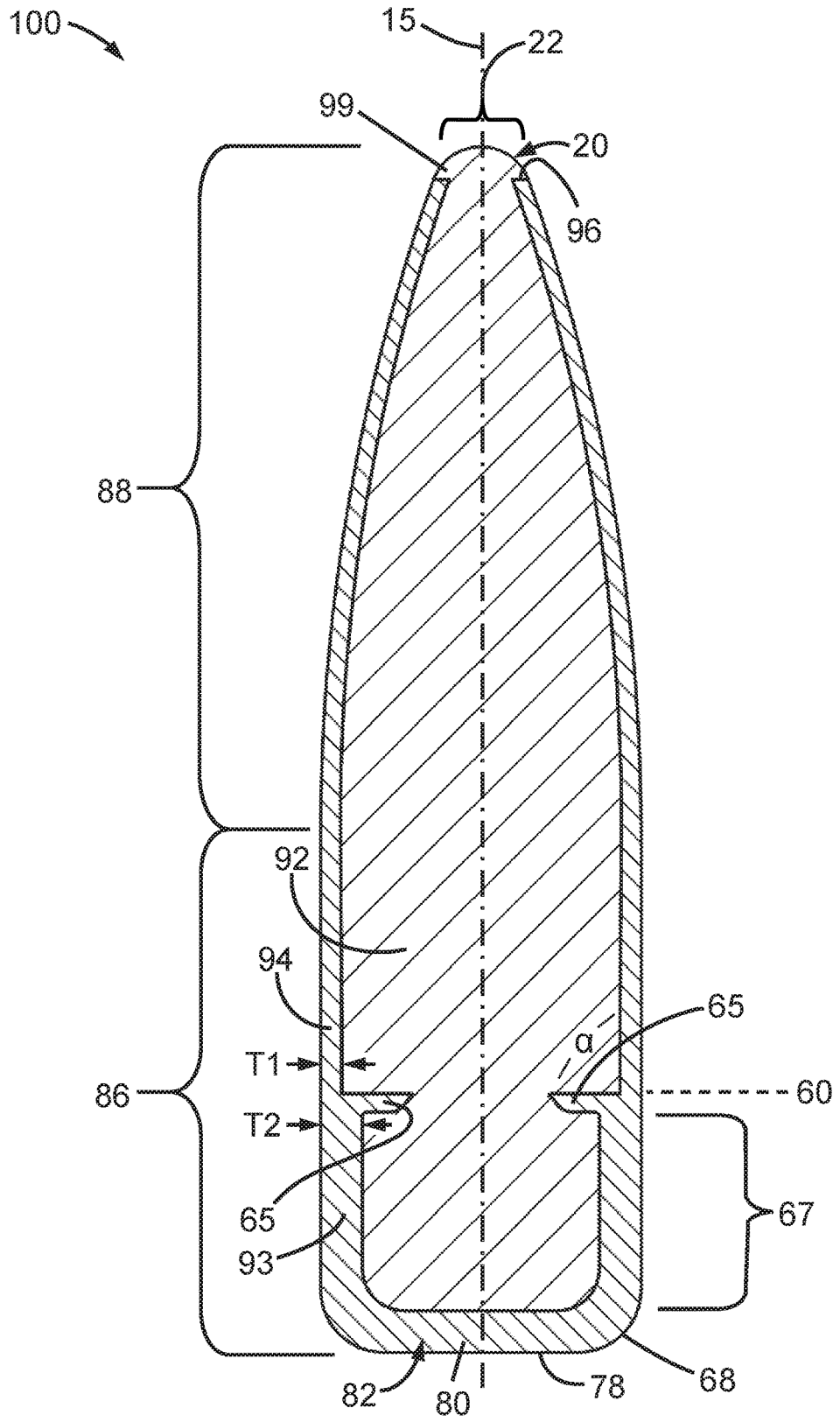
FIG. 2 is a longitudinal cross-sectional view of a profiled projectile oriented vertically, shown with a soft point tip, and including core-locking protrusions embedded in the core at a 90-degree locking angle, in accordance with an embodiment of the present disclosure.

FIG. 2 illustrates a longitudinal cross-sectional view of a fully formed projectile 100 made in accordance with another embodiment of the present disclosure. Projectile 100 is particularly useful in rifle ammunition and is configured as a soft-point projectile with a projectile tip 20 of exposed core 92 material. Core-locking protrusions 65 have been forced during the seating process to provide locking angle α from about 85-95 degrees with respect to inside surface 82*b* of forward sidewall 94. In other embodiments, locking angle α is from 88-92 degrees, such as 90 degrees. The locking angle α of about 90 degrees (as well as other locking angles) is substantially maintained while forming the completed projectile 100 due to equilibrium of forces during the core-seating process. A 90-degree locking angle α may be desirable when the projectile 100 is launched from a very high-velocity cartridge as a more pronounced locking angle α provides enhanced core-gripping ability upon impact with a target.

Figure 3:
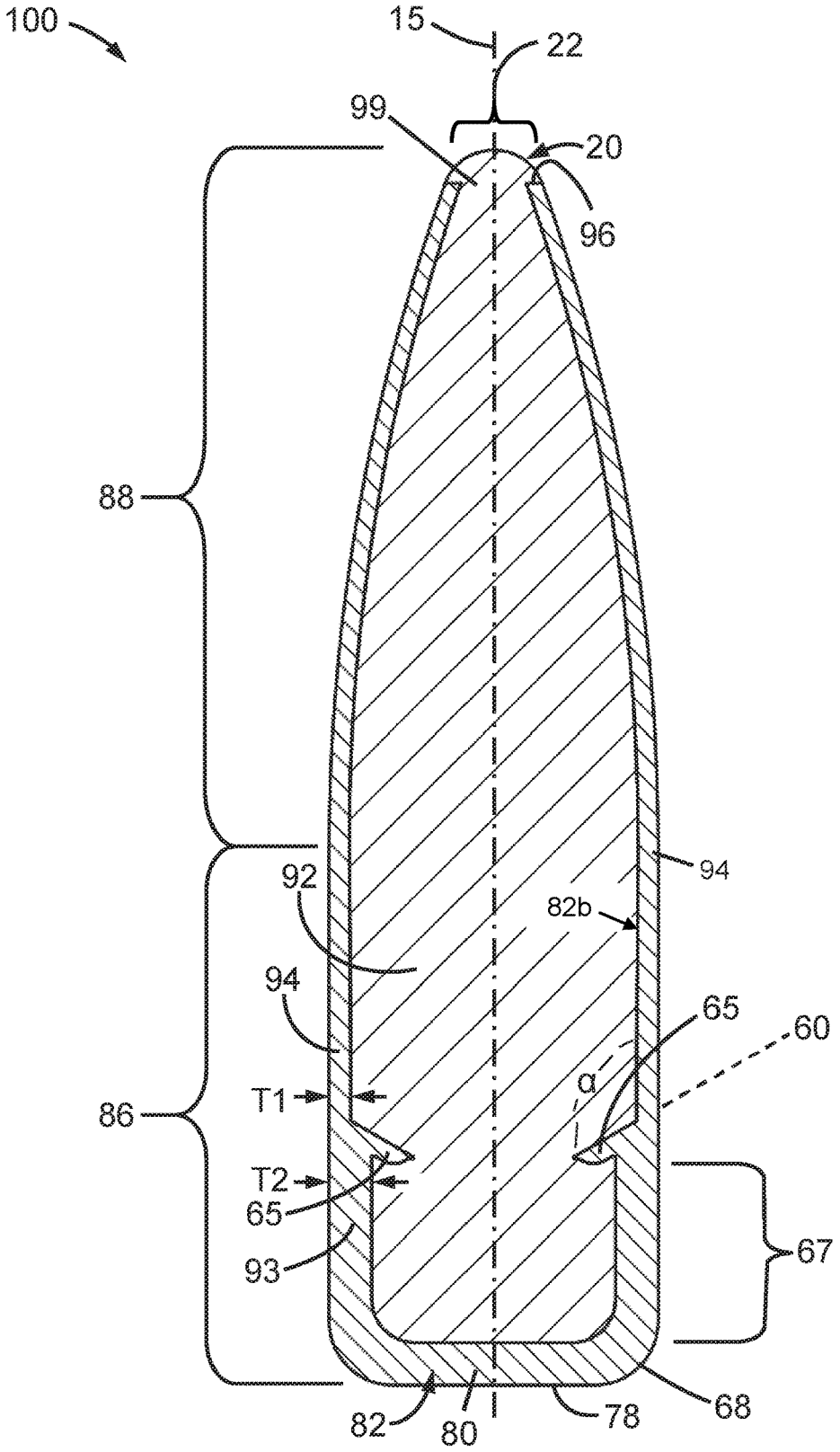
FIG. 3 is a longitudinal cross-sectional view of a profiled projectile oriented vertically and shown with a soft point tip and core-locking protrusions embedded in the core at a 120-degree locking angle, in accordance with an embodiment of the present disclosure.

FIG. 3 illustrates a longitudinal cross-sectional view of a fully-formed projectile 100 made in accordance with another embodiment of the present disclosure. Projectile 100 is well-suited for use in rifle cartridges and is configured as a soft-point projectile with projectile tip 20 of exposed core 92 material. Core-locking protrusions 65 have been forced during the core-seating process to assume locking angle α of about 120 degrees with respect to inside surface 82*b* of forward sidewall 94. A locking angle α greater than 90 degrees, such as 120 degrees, may be desirable when the projectile 100 is launched from a very high-velocity cartridge and also has a substantial core mass, thereby generating a very high inertial force during impact with a target. Core-locking protrusions 65 set at locking angle α of about 120 degrees can provide a very high degree of core-gripping ability to arrest forward movement of core 92 within jacket 82 upon impact with a target.

Figure 4:
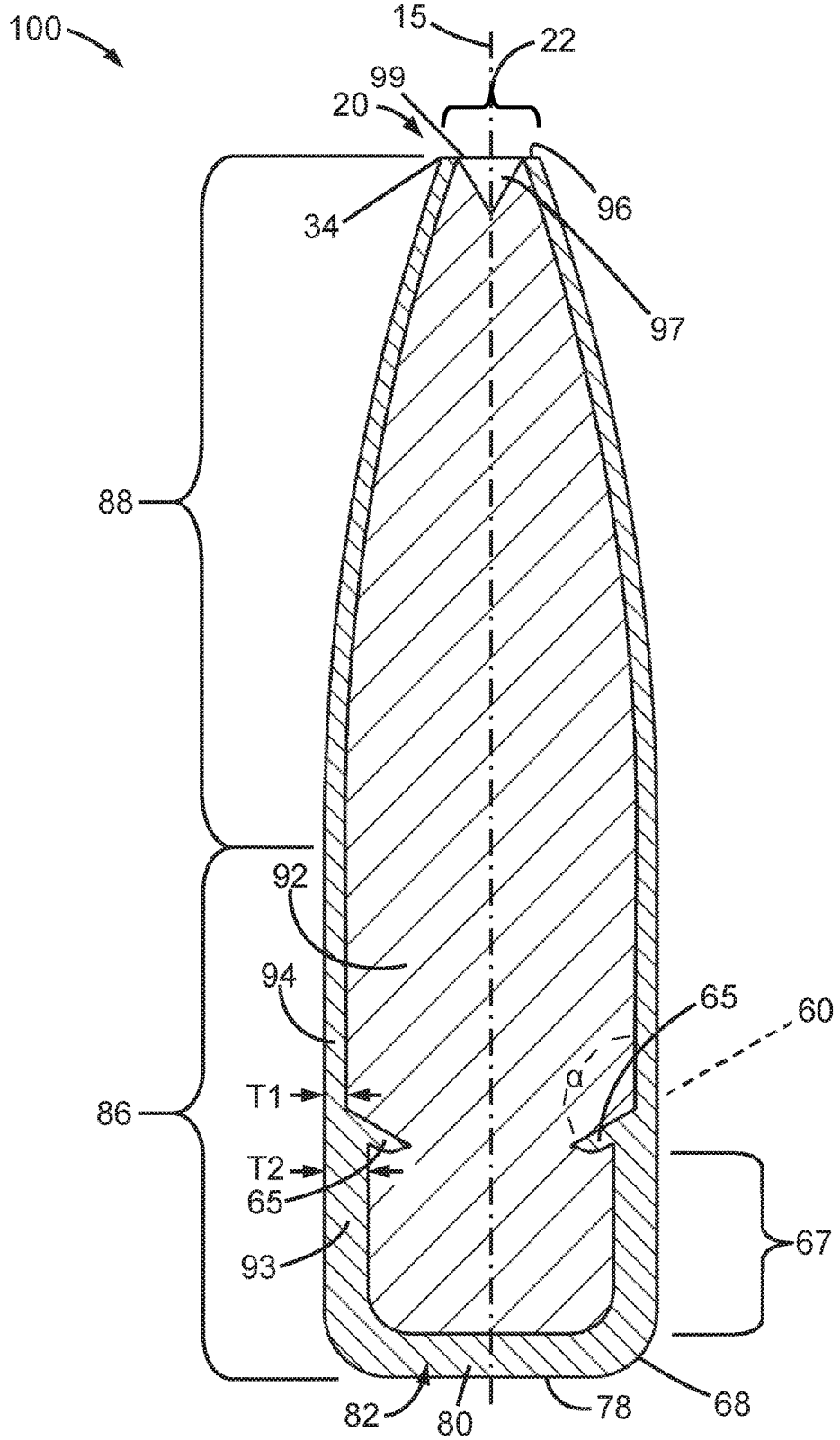
FIG. 4 is a longitudinal cross-sectional view of a profiled projectile oriented vertically, shown with a simple hollow point in its tip, and including core-locking projectiles embedded downward into the core at a 120-degree locking angle, in accordance with an embodiment of the present disclosure.

FIG. 4 illustrates a longitudinal cross-sectional view of a fully formed projectile 100 made in accordance with another embodiment of the present disclosure. Similar to embodiments discussed above, projectile 100 is well-suited for use in rifle cartridges. Projectile 100 is configured with a hollow-point cavity 97 defined within open front end 99. A generally flat projectile tip 20 across rim 96 of open front end 99 provides a wider meplat 22 than soft-point configurations, such as depicted in FIGS. 1-3. While a simple conical shape is shown, cavity 97 may assume any desired shape, including frustoconical, cylindrical, spherical, ovoid, and the like. The forward terminus 34 of projectile 100 can be the rim 96 of jacket 82 without exposed core 92 material forward of the rim 96. Core-locking protrusions 65 shown in FIG. 4 are set at locking angle α of about 120 degrees as a result of the core-seating process, but any locking angle α from 60 to 120 degrees is acceptable. A locking angle α of about 120 degrees provides a further improved core-gripping ability that is often desirable in a hollow point projectile 100, especially if both ogive portion 88 and forward sidewall 94 of shank 86 greatly expand radially on impact. The hollow-point projectile tip 20 with cavity 97 is shown here to illustrate an example of the many projectile tip 20 options contemplated for projectiles 100 of the present disclosure.

Figure 5:
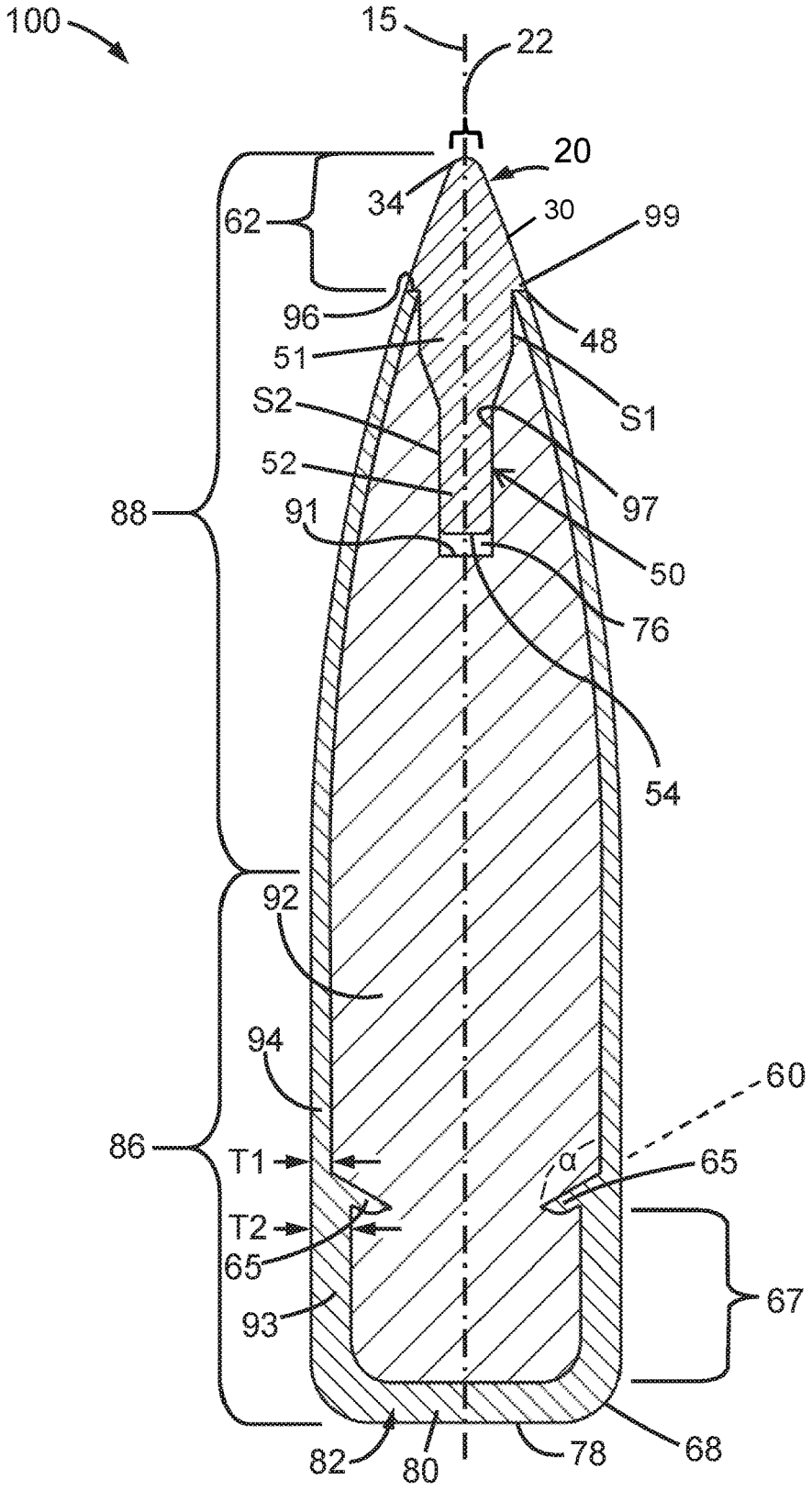
FIG. 5 is a longitudinal cross-sectional view of a profiled projectile oriented vertically, shown with a polymer tip, and including core-locking protrusions embedded downward into the core at a 120-degree locking angle, in accordance with an embodiment of the present disclosure.

FIG. 5 illustrates a longitudinal cross-sectional view of a fully formed projectile 100 made in accordance with another embodiment of the present disclosure. Similar to embodiments discussed above, projectile 100 shown in FIG. 5 is well-suited for use in rifle cartridges. Projectile 100 shown in FIG. 5 is configured with a tip insert 30 that defines projectile tip 20 and extends through open front end 99 into core 92. Tip insert 30 is made of a polymer in some embodiments, but can be made of other materials including ceramic, metal, and other materials. Tip insert 30 has a tip shoulder 48 that is received against rim 96 of jacket 82 with an exposed tip portion 62 extending forward of open front end 99 of ogive portion 88 to a pointed or rounded forward terminus 34. In some embodiments, tip insert 30 can be pointed at its forward terminus 34 to provide a reduced meplat 22 for an improved ballistic coefficient for projectile 100. A tip shank portion 50 extends rearwardly from exposed tip portion 62 and includes a first shank portion 51 of larger diameter S1 and a second shank portion 52 of smaller diameter S2 rearward of the first shank portion 51. Core 92 defines a generally cylindrical cavity 97 with a first cavity portion of larger diameter S1 sized for and corresponding to first shank portion 51 of larger diameter S1, and a second cavity portion of smaller diameter S2 sized for and corresponding to a second shank portion 52 of smaller diameter S2.

First shank portion 51 of larger diameter S1 is tightly gripped by rim 96 adjacent tip shoulder 48 to retain tip insert 30 with core 92. In some embodiments, projectile 100 defines a centralized air gap 76 in cavity 97, where air gap 76 is positioned axially between a rear end 54 of tip shank portion 50 and bottom 91 of cavity 97. Air gap 76 can be of any size and shape. A purpose of air gap 76 is to facilitate projectile expansion as tip insert 30 is driven rearward into core 92 upon impacting a target. As discussed above for hollow-point projectile 100 of FIG. 4, a locking angle α of about 120 degrees may be used when projectile 100 includes tip insert 30. Tip insert 30 is shown here to illustrate another example of the many projectile tip 20 options contemplated for projectiles 100 of the present disclosure.

It is contemplated that any configuration of projectile tip 20 can be used in each of the embodiments presented in FIGS. 1-5 and FIGS. 22 and 23, regardless of the ultimate locking angle α of the core-locking protrusions 65. It is also contemplated that any type or number of nose-weakening features (e.g., skives, scores, slits, etc.) can be used in any embodiment of the present disclosure to facilitate expansion of projectile 100 on impact.

It is further contemplated that any of the features discussed above may be used in projectiles 100 configured for rifle ammunition or pistol ammunition. A projectile 100 for pistol ammunition with ogive portion 88 can be configured, for example, with a tangent ogive shape, a truncated cone nose profile, or other shape. Regardless of its ogive curvature, nose angle, or profile, a much wider meplat 22 than that shown for the projectile in FIG. 4 would normally be used for pistol ammunition. The shape of the projectile tip 20 in a projectile 100 used with pistol ammunition may generally be flat, but its meplat 22 can be much wider than the flat projectile tip 20 and meplat 22 shown in projectile 100 of FIG. 4. A flat projectile tip 20 may also incorporate a hollow-point cavity 97 of any desired shape. The forward terminus 34 of the projectile tip 20 in a pistol projectile may comprise jacket 82 material or, if desired, can be exposed lead or any other malleable core 92 material.

Figure 6:
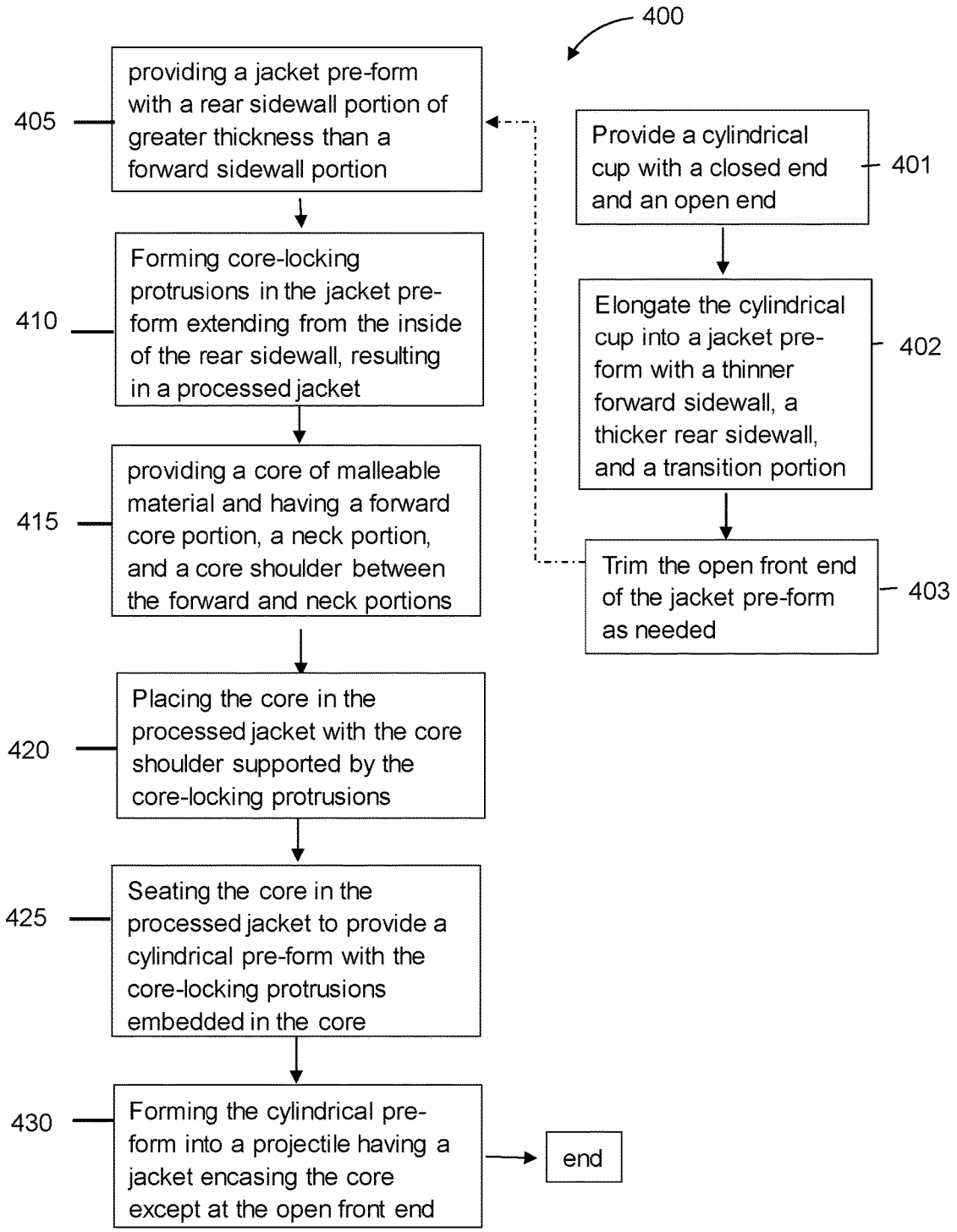
FIG. 6 is a flow chart illustrating example steps in a method of making an expanding projectile, in accordance with an embodiment of the present disclosure.

Referring now to FIG. 6, a flowchart illustrates example steps in a method 400 of making an expanding projectile 100 in accordance with the present disclosure. Method 400 is further discussed below with reference to FIGS. 7-21, which illustrate embodiments of projectile 100 in various stages of production as well as a dividing punch used in one method of forming core-locking protrusions 65, in accordance with some embodiments.

In one embodiment, method 400 includes providing 405 a jacket pre-form 150 having a rear sidewall 93 and a forward sidewall 94, where the rear sidewall thickness T2 is greater than the forward sidewall thickness T1, and where the jacket pre-form 150 defines a shoulder 61 between the forward sidewall 94 and the rear sidewall 93. In some embodiments, providing 405 the jacket pre-form 150 optionally includes providing 401 a cylindrical cup with a closed end and an open end and then elongating 402 the cylindrical cup into the jacket pre-form. As a further option, the pre-form front end 102 of the jacket pre-form 150 can be trimmed 403 as needed to define rim 96 with the desired profile. Next, a plurality of core-locking protrusions 65 are formed 410 from the inside of rear sidewall portion 93 of jacket pre-form 405.

In one embodiment, core 92 is formed or provided 415 with a first core portion 33, a neck portion 36, and a core shoulder 31 between the first core portion 33 and the neck portion 36. Core 92 is dropped or otherwise placed 420 in jacket pre-form 150 with core shoulder 31 supported by core-locking protrusions 65. Core 92 is seated 425 in jacket pre-form 150, resulting in a cylindrical pre-form 220 with the core-locking protrusions 65 embedded in the core 92. In some embodiments, the step of seating 425 the core 92 involves two actions performed, for example, using a flat-ended seating punch. First, core 92 is compressed axially to bend core-locking protrusions 65 to locking angle α and to partially embed core locking protrusions 65 into core 92. Next, core 92 is further axially compressed and caused to radially expand to fill the locking chamber 67 and to fully embed core-locking protrusions 65 in core 92. This second portion of seating 425 core 92 displaces gaps between the jacket pre-form 150 and core 92 with core 92 material.

The cylindrical pre-form 220 is subsequently formed 430 into projectile 100 having jacket 82 encasing the core 92 except at the open front end 99 and with core-locking protrusions 65 embedded in core 92. Examples and further details of steps in method 400 are discussed below.

Figure 7:
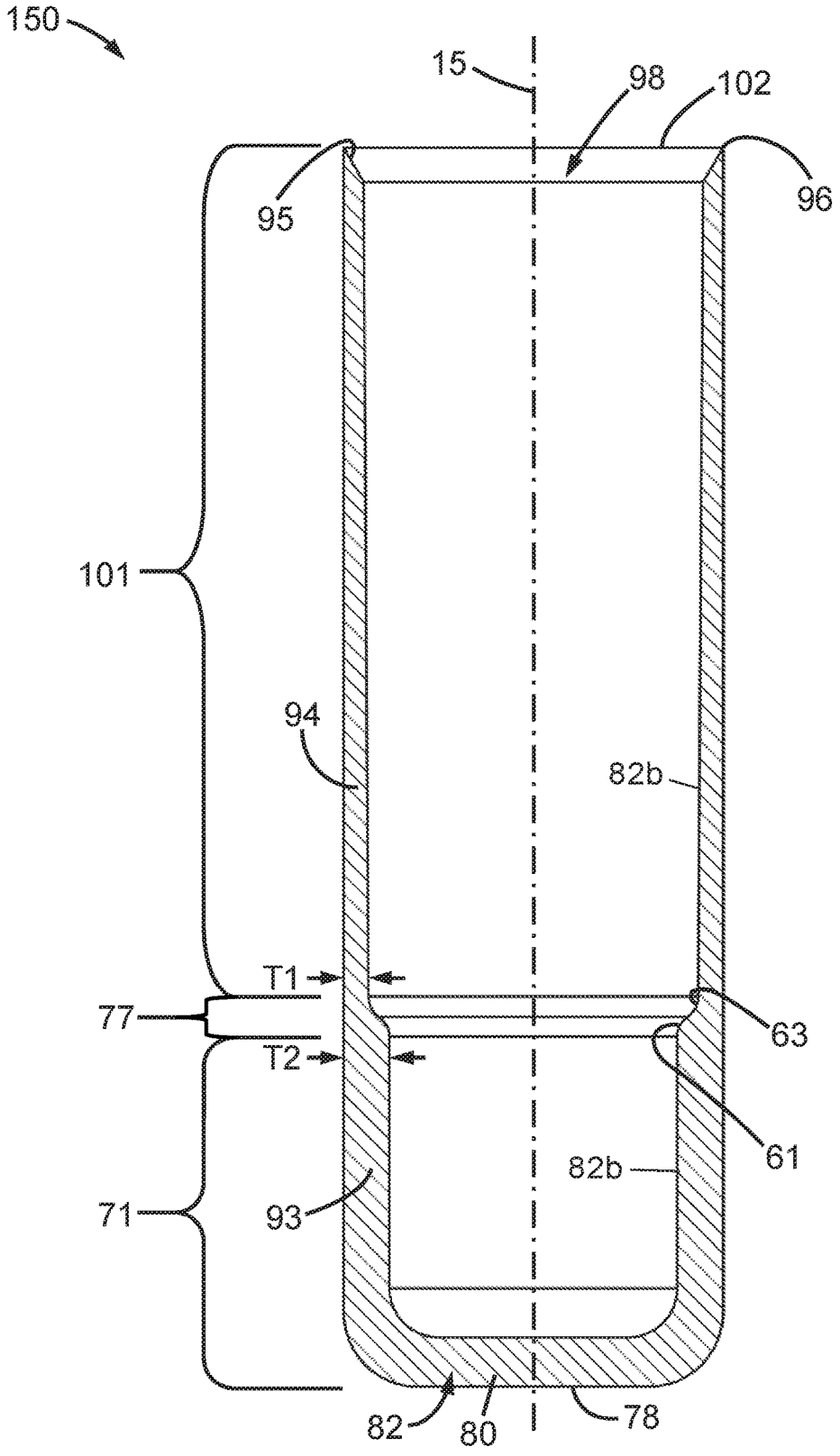
FIG. 7 is a longitudinal cross-sectional view of an empty cylindrical jacket pre-form oriented vertically and shown prior to the formation of multiple core-locking protrusions, in accordance with an embodiment of the present disclosure.

FIG. 7 illustrates a longitudinal cross-sectional view of an empty cylindrical jacket pre-form 150 prior to the forming 405 core-locking protrusions 65. The jacket pre-form 150 is formed, for example, by providing 401 a shorter, thick-walled copper or copper-alloy cup (not shown). The cup is subjected to a series of draw steps using cylindrical dies and two-diameter punches of various sizes. In doing so, the cup is elongated 402 into jacket pre-form 150 as shown in FIG.

7 with a smaller forward sidewall thickness T1, a larger rear sidewall thickness T2, and a transition portion 77 between forward sidewall 94 and rear sidewall 93.

In some embodiments, jacket pre-form 150 has an open mouth area 98 with a pre-form front end 102 of irregular shape. Optionally, pre-form front end 102 can be trimmed 403 as needed, such as by pinch-trimming, to define a rim 96 with an inside radius 95. After trimming 403 the pre-form front end 102, the circular rim 96 at the pre-form front end 102 extends substantially perpendicular to central axis 15. The resulting jacket pre-form 150 is a cylindrical tube that is symmetrical in rotation about central axis 15 with a closed rear end 78 and an open pre-form front end 102 with rim 96 that extends substantially perpendicularly to central axis 15. The cylindrical jacket pre-form 150 comprises three portions that include (i) a cylindrical rear portion 71 with a closed rear end 78 and a rear sidewall 93 with rear sidewall thickness T2, (ii) a transition portion 77 comprising a convexly-rounded shoulder 61 extending from inside surface 82*b* of rear sidewall 93 to a concavely-rounded region 63 extending from shoulder 61 to inside surface 82*b* of forward sidewall 94, and (iii) a forward portion 101 comprising a thinner forward wall 94 with forward sidewall thickness T1 that is less than rear sidewall thickness T2. The inside surface 82*b* of forward sidewall 94 and/or rear sidewall 93 can be parallel to central axis 15, or if desired, can have a slight amount of draft or taper.

Figure 8:
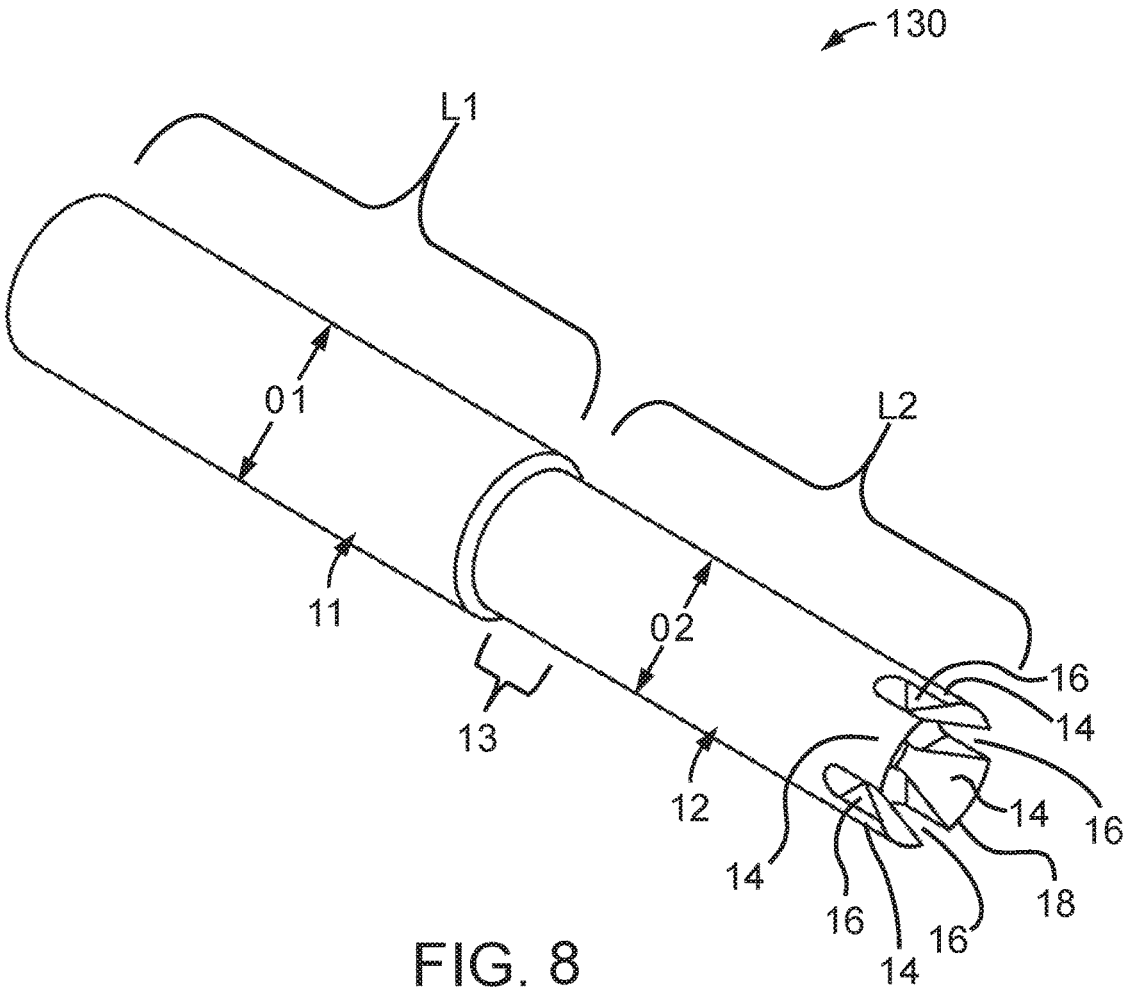
FIG. 8 is an isometric view of a multi-bladed dividing punch useful to form core-locking protrusions, in accordance with an embodiment of the present disclosure.

FIG. 8 illustrates an isometric view of a multi-bladed dividing punch 130 used in one embodiment of method 400 to form 410 core-locking protrusions 65. The dividing punch 130 can be slidably received within a cylindrical die (not shown). The dividing punch 130 has a punch alignment end 11 with a first length L1 and a working end 12 with a second length L2. Alignment end 11 has a first diameter D1 and working end 12 has a second diameter D2. The overall length of the dividing punch 130 equals the sum of first length L1 and second length L2, and can be any length desired to allow compatibility and functionality when installed in high-speed production machinery. The dividing punch 130 can utilize threads or any other means necessary to secure it within the high-speed production machinery. In some embodiments, first diameter D1 of alignment end 11 is about 0.0005" to 0.001" inch smaller than the inside diameter of the cylindrical die within which it operates. In some embodiments, working end 12 of dividing punch 130 has a diameter D2 that is between about 0.0005" and 0.0015" smaller than the inside diameter of the forward sidewall 94 of jacket pre-form 150 (shown in FIG. 7).

The working end 12 of the dividing punch 130 has a plurality of blades 14 separated from one another by an equal number of U-shaped slots or windows 16. Windows 16 can be cut out of working end 12 using, for example, a milling process or an Electric Discharge Machine (EDM) process. In one embodiment, the dividing punch 130 has four blades 14 for making four core-locking protrusions 65 in jacket 82. The working end 12 of the dividing punch 130 has a sharp cutting edge 18. For example, the cutting edge 18 has an edge width from about 0.005" to 0.015", rendering cutting edge 18 sufficiently sharp to penetrate the shoulder 61 of the cylindrical jacket pre-form 150. The second length L2 of the working end 12 of the dividing punch 130 includes additional axial length 13 compared to jacket 82 in order to accommodate the thickness of a stripper disk or stripper plate (not shown) used to strip the processed jacket 160 (shown, e.g., in FIGS. 13A-13-D, and FIG. 14) off the working end 12 of the dividing punch 130 after the core-locking protrusions 65 have been formed 410.

Figure 9:
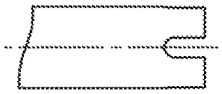
FIG. 9 is a side view of the bladed, working end of the multi-bladed dividing punch shown in FIG. 8.
Figure 10A:
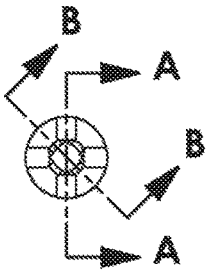
FIG. 10A is an end view of the bladed, working end of the multi-bladed dividing punch shown in FIG. 9.
Figure 10B:
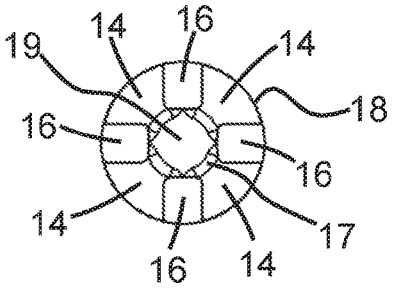
FIG. 10B is a larger, more detailed end view of the working end of the multi-bladed dividing punch shown in FIG. 10A.

FIGS. 9, 10A, 10B, 11, and 12 illustrate various views of a portion of the working end 12 of the dividing punch 130 shown in FIG. 8. FIG. 9 is a side view of a forward portion of the working end 12 of the dividing punch 130. FIG. 10A is an end view of the working end 12 of the dividing punch 130 showing the sectional directionality associated with FIGS. 11 and 12. FIG. 10B is an enlarged end view of the dividing punch 130 of FIG. 10A showing details of the U-shaped windows 16 between adjacent blades 14. In some embodiments, working end 12 includes a fillet 17 (i.e., a small radius) adjacent a central base 19 between blades 14 for added strength.

Figure 12:
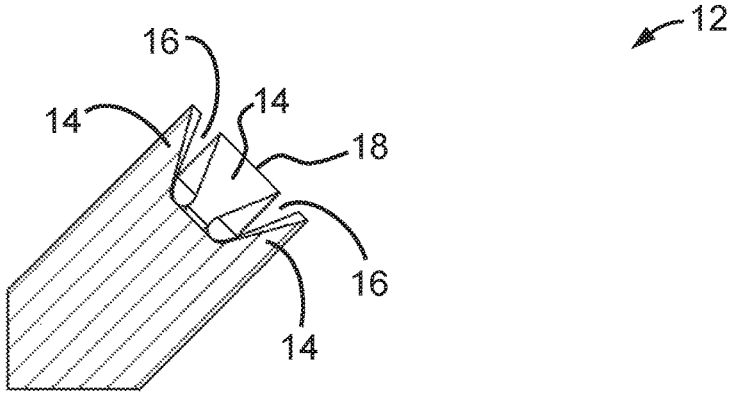
FIG. 12 is a section taken along line B-B of FIG. 10A showing a longitudinal cross-sectional view of the bladed, working end of the multi-bladed dividing punch.
Figure 11:
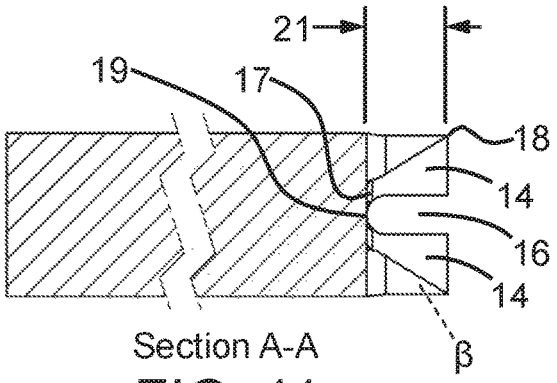
FIG. 11 is a section taken along line A-A of FIG. 10A showing a longitudinal cross-sectional view of the bladed, working end of the multi-bladed dividing punch.

FIG. 11 is a longitudinal cross-sectional view of working end 12 taken along line A-A of FIG. 10A and shows a forward portion of the bladed, working end 12 of the dividing punch 130. FIG. 12 is a longitudinal cross-section taken along line B-B of FIG. 10A and shows a portion of the bladed, working end 12 of the dividing punch 130. The blades 14 include cutting edge 18 and are spaced circumferentially by windows 16. It has been discovered that the optimum blade angle β in some embodiments of each dividing punch 130 blade 14 is 30 degrees. In other embodiments, blade angle β can have other values, such as being increased to 45 degrees. The sharp cutting edge 18 of the blades 14 allows the dividing punch 130 to easily penetrate the shoulder 61 of the empty cylindrical jacket pre-form 150. In some embodiments, each blade 14 has an axial height 21 from about 0.075" to about 0.250", depending on projectile diameter and the ultimate application or use of the projectile 100.

Figures 13A, 13B, 13C, 13D:
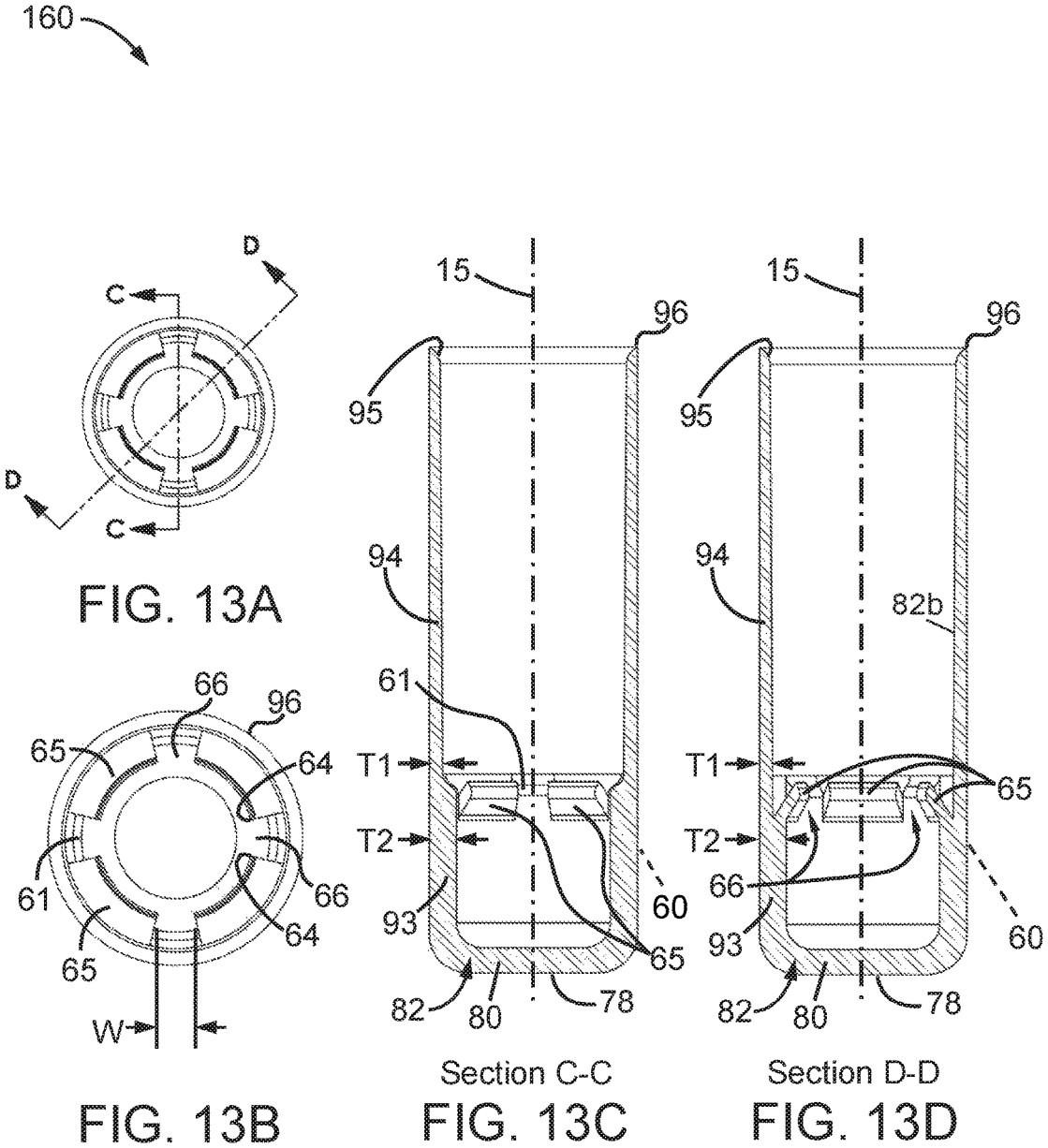
FIG. 13A is an end view of an empty, cylindrical processed jacket showing four core-locking protrusions that have been formed by the multi-bladed dividing punch shown in FIGS. 8-12, in accordance with an embodiment of the present disclosure.
FIG. 13B is a larger, more detailed end view of the processed jacket shown in FIG. 13A.
FIG. 13C is a longitudinal cross-sectional view of the processed jacket taken along line C-C of FIG. 13A, showing the geometry of the spaced core-locking protrusions.
FIG. 13D is a longitudinal cross-sectional view of the processed jacket taken along line D-D of FIG. 13A, showing the geometry of the spaced core-locking protrusions.

FIGS. 13A, 13B, 13C, and 13D illustrate various views of an empty, processed jacket 160 after the shoulder 61 area of the jacket pre-form 150 has been penetrated by the blades 14 on the working end 12 of the dividing punch 130 (shown in FIG. 8). FIG. 13A is an end view of a processed jacket 160 showing the sectional directionality associated with FIGS. 13C and 13D. FIG. 13B is an enlarged end view of the processed jacket 160 shown in FIG. 13A and shows the result produced by the axially-directed penetration of four spaced blades 14 present in the working end 12 of an embodiment of the dividing punch 130. As the dividing punch 130 begins its axial travel into the jacket pre-form 150, the sharp cutting edge 18 on each blade 14 of the dividing punch 130 initially makes contact with the concavely-rounded region 63 of transition portion 77 (shown in FIG. 7). As the dividing punch 130 continues into the jacket pre-form 150, the blades 14 penetrate the shoulder 61 and a forward portion of the thicker rear sidewall 93 of the jacket 82. This action ultimately forms core-locking protrusions 65 that each extend longitudinally and radially inward towards the axis 15 of the jacket 82 at blade angle β. In some embodiments, core-locking protrusions 65 are substantially symmetrical. After being formed, the core-locking protrusions 65 in the processed jacket 160 extend along protrusion axis 60 at blade angle β relative to the inside surface 82*b* of forward sidewall 94, consistent with the blade angle β of the blades 14 of the dividing punch 130 (shown in FIG. 11). In some embodiments, the blade angle β and the resulting angle of the core-locking protrusions 65 as initially formed can both be as great as 45 degrees. In other embodiments, the blade angle β and resulting angle of the core-locking protrusions is about 30 degrees. In yet other embodiments, the blade angle β and resulting angle of the core-locking protrusions is less than 30 degrees. Increasing the blade angle β from 30 to 45 degrees increases the strength of dividing punch 130.

As shown in the end view of FIG. 13B, one embodiment of processed jacket 160 has four core-locking protrusions 65 separated circumferentially by spaces 66, where core-locking protrusions 65 and spaces 66 are evenly distributed and arranged symmetrically about central axis 15. Each space 66 corresponds to a portion of rear sidewall 93 that is undisturbed by dividing punch 130 and retains a full rear sidewall thickness T2. That is, each space 66 aligns with the unpenetrated shoulder 61 of the jacket pre-form 150. These solid, un-cut (un-penetrated) areas of shoulder 61 provide strength in the rear sidewall 93 adjacent the core-locking members 65 and prevent the jacket 82 from shearing, bending, collapsing or otherwise deforming upon impact with a hard target, such as bone, metal, or windshield glass.

Core-locking protrusions 65 can have a length as needed to engage core 92. An increased length of core-locking protrusions 65 is accomplished by forcing the blades 14 of the dividing punch 130 to penetrate deeper into the rear sidewall 93 of the jacket 82. However, a practical limit exists to the amount of axial height that can be achieved in the core-locking protrusions 65. In some embodiments, a circumferential width "W" (FIG. 13B) of the spaces 66 separating the core-locking protrusions 65 from one another can be sized so that the corners 64 of neighboring core-locking protrusions 65 do not make contact with one another when the core 92 is seated within the jacket 82 and causes the core-locking protrusions 65 to extend radially inward towards the central axis 15. A crowded arrangement of core-locking protrusions 65 could result in partial deformation of the core-locking protrusions 65 as they bend inwardly and approach a 90-degree locking angle $\alpha$ during the subsequent step of seating 425 the core 92. With respect to the advantage gained, core-locking protrusions 65 of greater length ultimately provide even greater core-gripping ability since longer core-locking protrusions 65 can be forced further (e.g., radially) into the core 92 material during the step of seating 425 the core 92. The steps of seating 425 the core 92 are discussed below with reference to FIGS. 16-18 and FIGS. 19-21. In some embodiments, a circumferential width of core-locking protrusions 65 along the sidewall is greater than the circumferential width W of spaces 66. In other embodiments, the circumferential width of core-locking protrusions 65 along the sidewall is less than the circumferential width W of spaces 66

Figure 14:
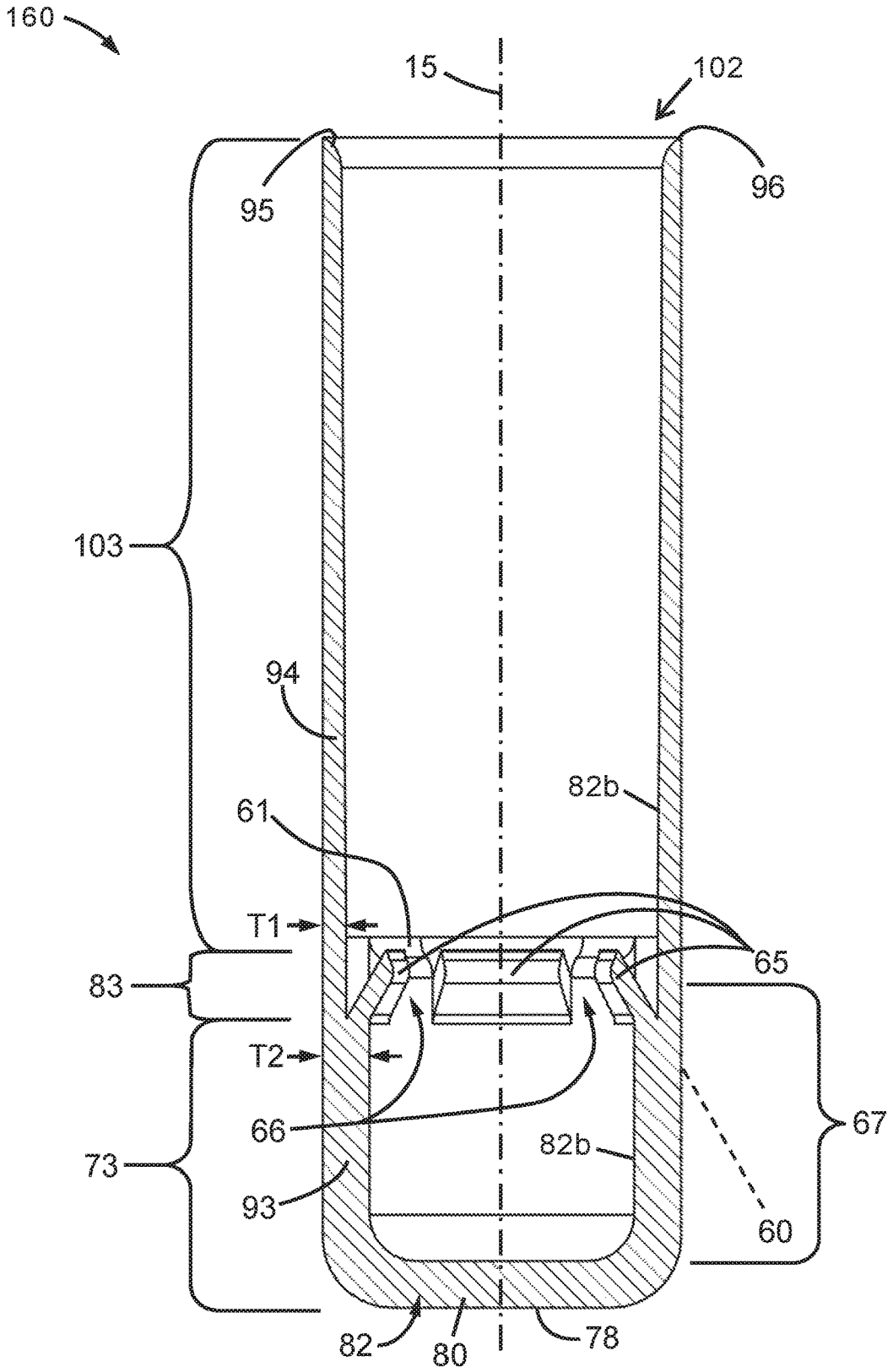
FIG. 14 is a larger, more detailed longitudinal cross-sectional view of the processed jacket shown in FIG. 13D.

FIG. 14 is a larger, more detailed view of the processed jacket 160 shown in FIG. 13D. Processed jacket 160 has three basic portions along its length between the rear end 78 of the base portion 80 and the front end or rim 96. Starting at the front or rim 96 and continuing rearward, processed jacket 160 has a relatively long forward sidewall 94 with forward sidewall thickness T1. A middle portion 83 represents the final axial height of the core-locking protrusions 65 after they have been fully formed and forced radially inward to about a 30-degree angle by the blades 14 of the dividing punch 130. Rearward of the middle portion 83 is the rear sidewall 93 with a thicker rear sidewall thickness T2 and closed base 80. The inside surface 82*b* of rear sidewall 93 and forward sidewall 94 can be parallel to the central axis 15 or can have a slight amount of draft or taper. Locking chamber 67 is defined between the rear sidewall 93, base 80, and the interrupted area rearward of the core-locking protrusions 65. Part of the core 92 is locked within the locking chamber 67 after the core 92 is seated 425 and the projectile 100 is formed 430.

Figure 15A:
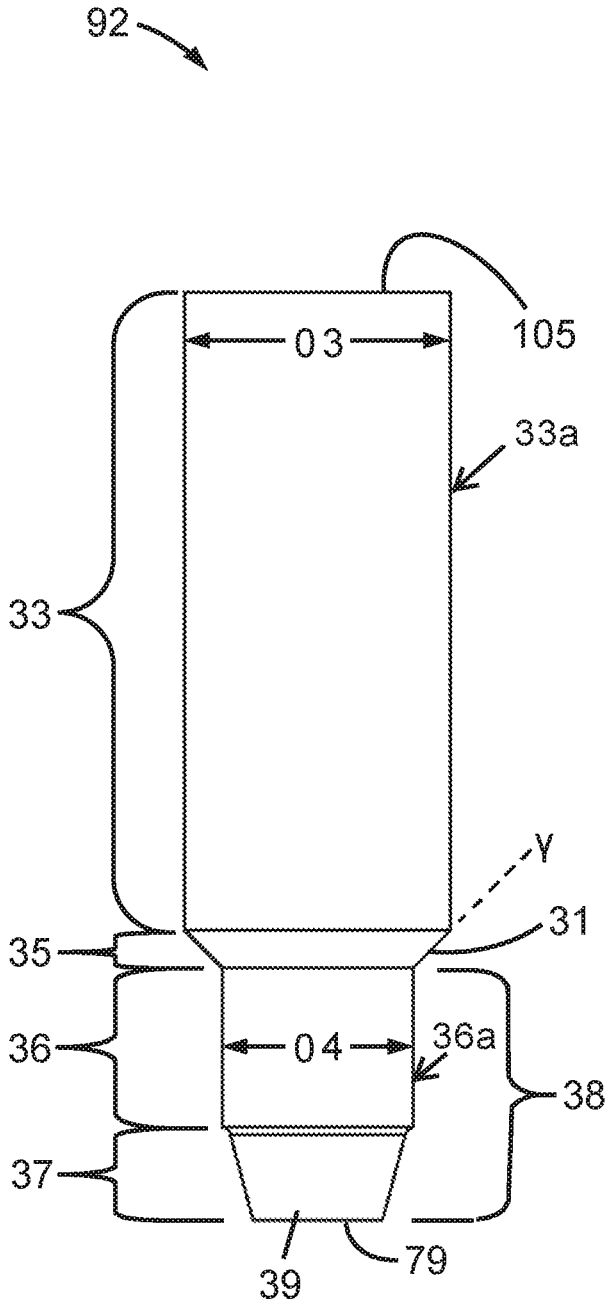
FIG. 15A is a side view of a malleable core having a long leading end prior to insertion into the empty processed jacket shown in FIG. 14, in accordance with an embodiment of the present disclosure.
Figure 15B:
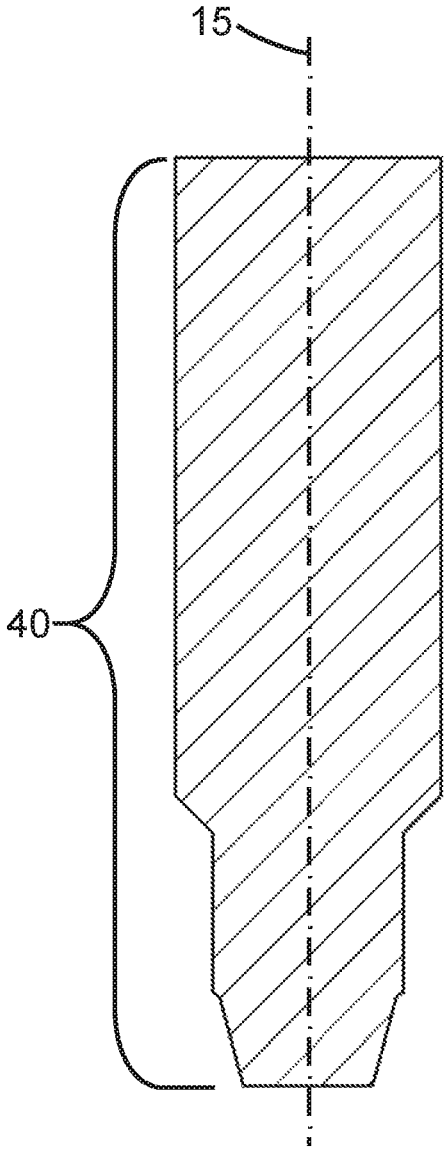
FIG. 15B is a longitudinal cross-sectional view of the core of FIG. 15A.

FIGS. 15A and 15B show an example of core 92 having one of several core shapes that are compatible with a projectile 100 in accordance with some embodiments of the present disclosure. In some embodiments as noted above, core 92 material can be lead or a lead-based alloy containing antimony. The core 92 can be pure lead or may comprise a lead alloy containing as much as 6% antimony. Other acceptable core 92 materials include tin, tin alloy, bismuth, bismuth alloy, and other malleable or frangible materials. In some embodiments, core 92 is made of a metal or metal alloy that is softer and more malleable than pure copper. As such, core 92 can readily flow around core-locking protrusions 65 during the manufacturing process.

FIG. 15A shows an elevational view of core 92 with an example of an acceptable shape to make projectiles 100 in accordance with embodiments of the present disclosure. Core 92 has a first core portion 33 with a generally cylindrical shape and a first core diameter D3. First core portion 33 extends from a forward end 105 to a core transition portion 35. Core transition portion 35 is between first core portion 33 and a second core portion or neck portion 36 and defines a core shoulder 31 with a core shoulder angle $\gamma$. Neck portion 36 extends rearward from transition portion 35 to core rear end 79 with a generally cylindrical shape and a second core diameter D4, where second core diameter D4 is smaller than first core diameter D3. In some embodiments, core shoulder angle $\gamma$ is from 30° to 60° relative to central axis 15, such as 45°. In some embodiments, core shoulder angle $\gamma$ is some other value, such as 90° to provide an abrupt transition from first core portion 33 to neck portion 36. A core shoulder angle $\gamma$ from 30° to 60° facilitates alignment of the core 92 within the jacket 82 during high-speed production. An outside surface 33*a* of first core portion 33 and an outside surface 36*a* of neck portion 36 can be parallel to the central axis 15 or, if desired, can have a slight amount of draft or taper to facilitate expulsion of the core 92 from a forming die (not shown) where the core 92 is initially formed and bled to its final weight.

The length 38 of the neck portion 36 is important for determining the locking angle $\alpha$ of the core-locking protrusions 65. A neck portion 36 of greater length 38 (as shown in FIGS. 15A and 15B) causes core-locking protrusions 65 to bend to a locking angle $\alpha$ as great as 90 degrees. However, a neck portion 36 of shorter length 38 may be required if the locking members 65 are to be bent to a greater locking angle $\alpha$ (e.g., 120 degrees).

Optionally, neck portion 36 includes a tapered tip portion 39. The tapered tip portion 39 is an optional feature of the core 92, but helps center the core 92 within the jacket 82 during high-speed production. In some embodiments, the tapered tip portion 39 can have a frustoconical shape, a rounded shape, or a conical shape. When core 92 lacks tapered end portion 39, neck portion 36 can terminate at core rear end 79 with a 90-degree angle. When core 92 lacks tapered tip portion 39, the length 38 of the neck portion 36 is generally equal to the length 38 of neck portion 36 when it does include tapered end portion 39. FIG. 15B is a longitudinal sectional view of core 92 shown in FIG. 15A. An overall length 40 of the core 92 includes the combined lengths of first portion 33, core transition portion 35, neck portion 36, and axial length 37 of tapered end portion 39.

Figure 16:
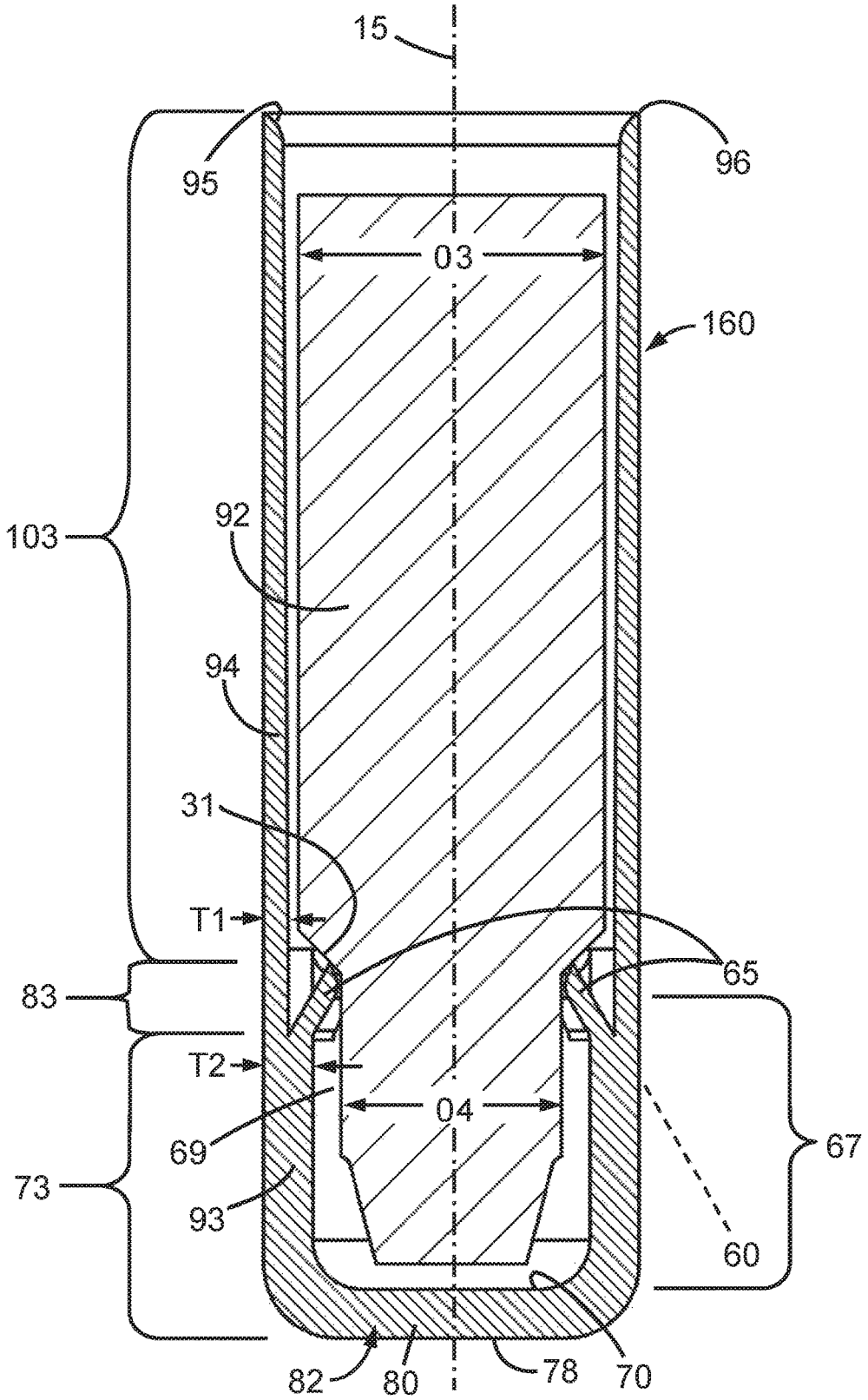
FIG. 16 is a longitudinal cross-sectional view of both the processed jacket and a core with a long leading end after the core has been dropped into a processed jacket, in accordance with an embodiment of the present disclosure.

FIG. 16 shows the processed jacket 160 shown in FIG. 14 after the core 92 shown in FIG. 15B has been dropped or otherwise placed 420 inside it with the neck portion 36 (and tapered end portion 39) passing through the centralized circular space (an imaginary circle) defined between ends or corners 64 of the core-locking protrusions 65 (refer to FIG. 13B). At this stage, the core 92 is loosely held within the processed jacket 160 and the core 92 is supported by shoulder 31 against the ends of the core-locking protrusions 65. An annular gap 69 exists between the neck portion 36 of the core 92 and rear sidewall 93. Here, core 92 includes a neck portion 36 of full or long length 38. In some embodiments, a "long" neck portion 36 has a length 38 from 0.20" to 0.50" depending on the type and caliber of projectile 100. This increased length 38 may be necessary to produce a core-locking angle α from 60 to 90 degrees during the core-seating process, while a shorter neck length 38 may be required to bend core-locking protrusions 65 to a locking angle α between 90 and 120 degrees. In some embodiments, a "short" neck portion 36 has a length 38 from 0.050" to 0.175" depending on the type and caliber of projectile 100. In some embodiments, a small amount of space exists between the interior rear surface 70 of the jacket 82 and the core rear end 79. The space helps to achieve even contact between the shoulder 31 of the core 92 and the ends of the core-locking protrusions 65. When core 92 is dropped or placed 420 into processed jacket 160, the core-locking protrusions 65 are disposed at a 30-degree angle or other angle consistent with blade angle β when core-locking protrusions 65 are formed 410. Placing 420 the core 92 in the jacket pre-form 150 is the first step in the component-marrying process associated with the projectile 100 having a core-locking angle α as great as 90 degrees.

Figure 17:
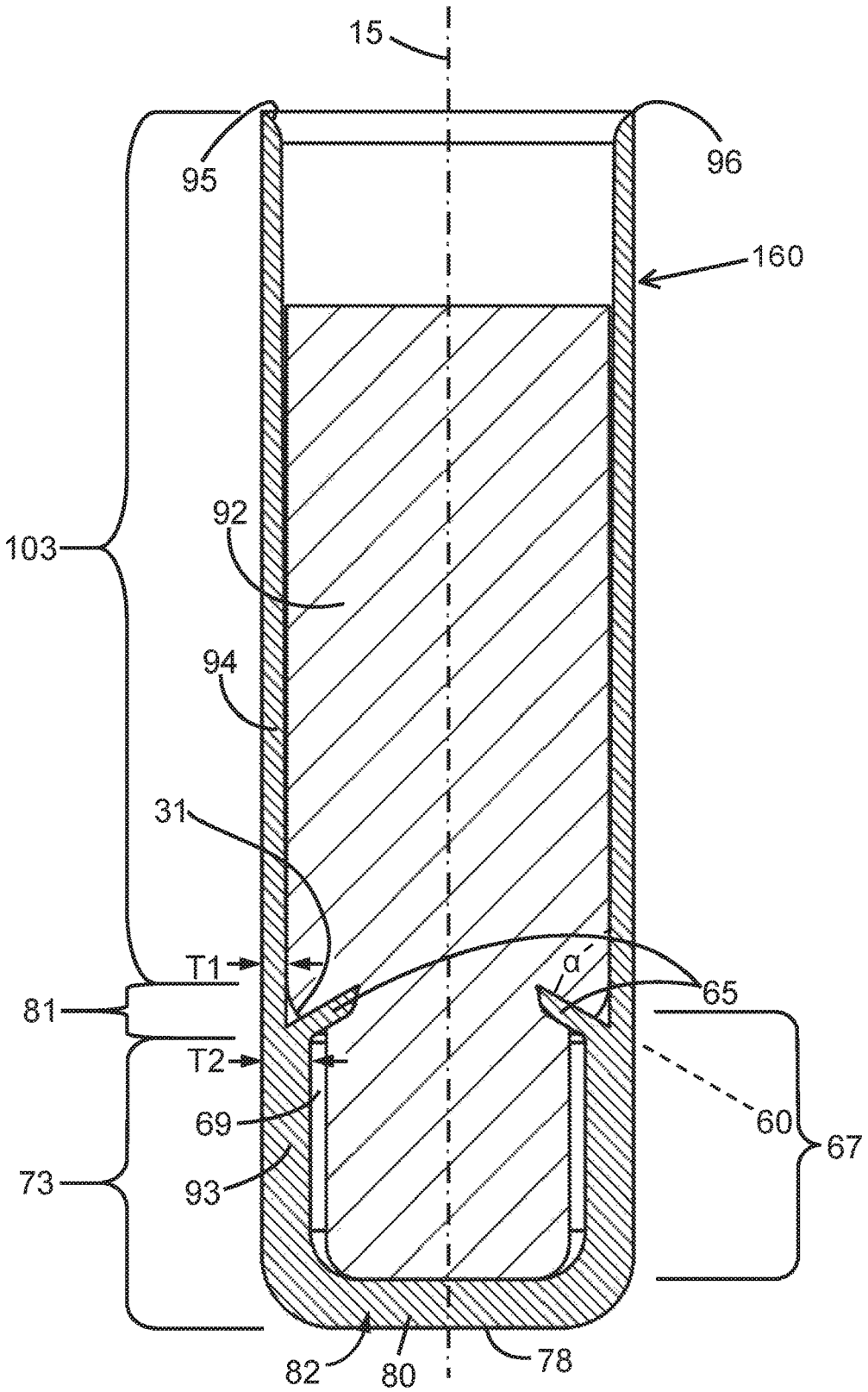
FIG. 17 is a longitudinal cross-sectional view of the processed jacket and the core with a long leading end of FIG. 16 after the core has been partially seated in the jacket, in accordance with an embodiment of the present disclosure.

FIG. 17 shows the processed jacket 160 and core 92 of FIG. 16 in a partially-married configuration after a flat-ended core seating punch (not shown) has begun to deform the core 92 and bend the core-locking protrusions 65 radially inward and rearward. In some embodiments, the pressure generated within the jacket 82 during the core-seating process can exceed 35,000 pounds per square inch (psi), allowing a great deal of work to be performed in bending the core locking members 65 and deforming the core 92. As shown, axially-oriented forces have axially compressed and radially expanded the core 92 to somewhat conform to the jacket 82. During this process, the core shoulder 31 is deformed as it presses against the top surfaces of the core-locking protrusions 65 and bends them downwardly. Bending the core-locking protrusions 65 occurs before maximum deformation and widening occurs in the neck portion 36 of the core 92. The sequence of events can be critical with respect to core-seating; completely filling the core-locking chamber 67 occurs after the core-locking members have been forced (bent) to their final core-locking angle α and embedded into core 92. The delay in filling the core-locking chamber 67 provides time for the shoulder 31 to bend the core-locking protrusions 65. As shown in FIG. 17, the air space 69 surrounding the now-deformed neck portion 36 of the core 92 has become narrower than that shown in FIG. 16 since the neck portion 36 has now grown in diameter. Even though the core 92 is only partially deformed at this point, it has already forced the core-locking protrusions 65 from their initial 30-degree angle to their final 60-degree locking angle α along protrusion axis 60. The final axial height 81 of the core-locking protrusions 65 is determined after core-locking protrusions 65 have been forced radially inward to their final locking angle α during the core-seating process. While FIG. 17 shows only a partial seating of the core 92, it illustrates the sequential progression involved in the second step of seating 425 the core 92 discussed below with reference to FIG. 18.

Figure 18:
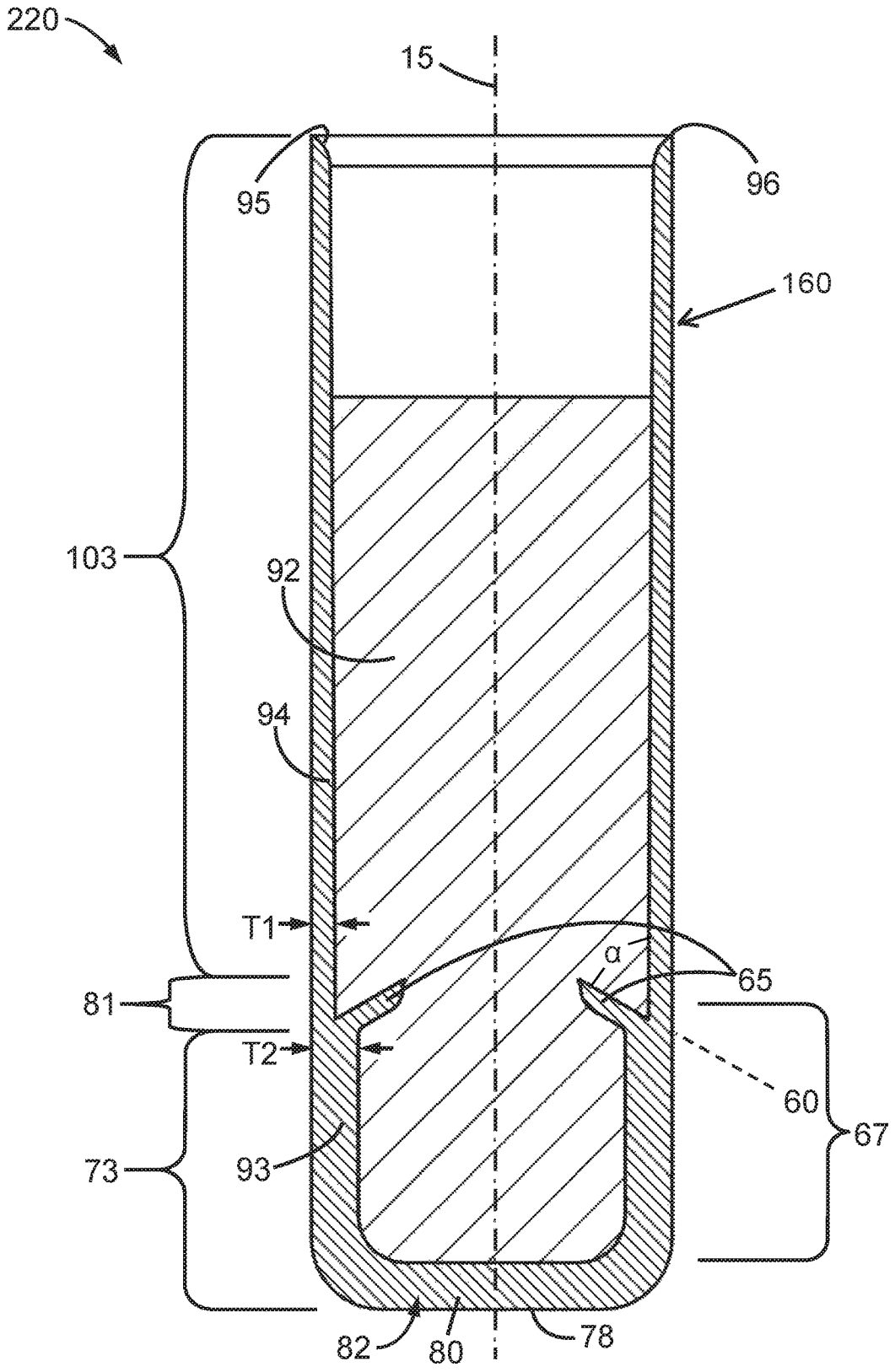
FIG. 18 is a longitudinal cross-sectional view of the processed jacket and the core with a long leading end of FIG. 16 after the core has been fully seated in the jacket, thus forming a cylindrical pre-form, in accordance with an embodiment of the present disclosure.

FIG. 18 shows core 92 and processed jacket 160 of FIG. 17 in a fully-married configuration known as a cylindrical pre-form 220 after the core 92 has been fully seated 425 in the processed jacket 160. The core seating punch (not shown) has been used to further axially compress and radially expand the core 92 to inside surface **82*b* of the processed jacket 160, thereby further embedding core-locking protrusions 65 and filling the majority of the processed jacket 160 and locking chamber 67 with core 92 material. In some embodiments, the core-locking protrusions 65 can be radially embedded into a rear portion of the core 92 to a depth between about 0.015" and 0.100", depending on projectile caliber, weight and type. The annular gap 69 that existed around the deformed neck portion 36 of the core 92 in FIG. 16 has been completely displaced by core 92 material. The final core-locking angle α of about 60 degrees shown in FIG. 18 has been maintained due to a state of equilibrium achieved from the timing and the delay involved in filling the locking chamber 67 with core 92 material. Displacing air between the core 92 and the inside surface 82*b* of processed jacket 160 is the second step of seating 425 core in the processed jacket 160. FIG. 18 shows the fully-married configuration for projectiles 100** having a core-locking angle α up to 90 degrees produced in accordance with the present disclosure.

Figure 19:
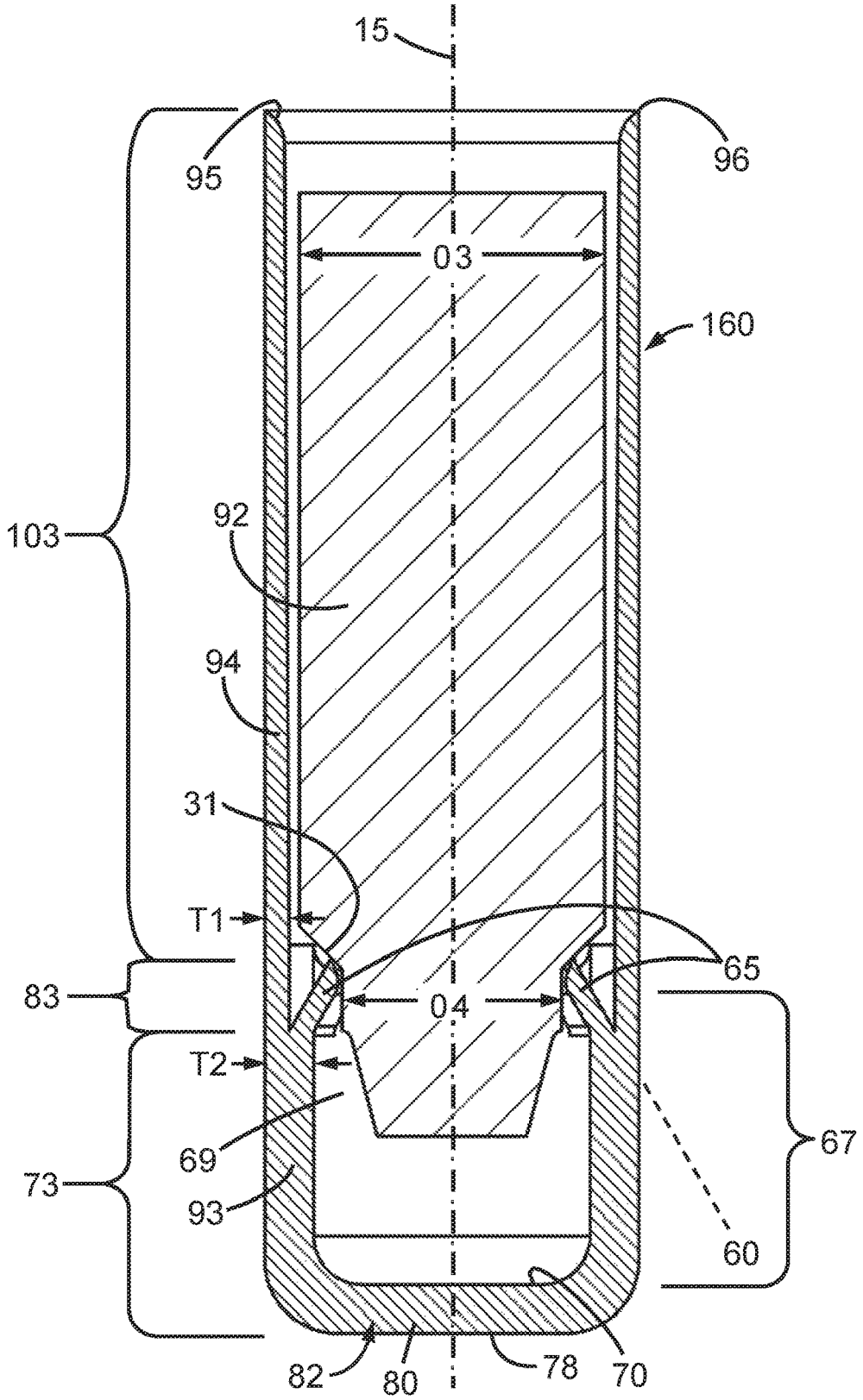
FIG. 19 is a longitudinal cross-sectional view of both the processed cylindrical jacket and a core with a short leading end after the core has been dropped into a processed jacket, in accordance with an embodiment of the present disclosure.
Figure 20:
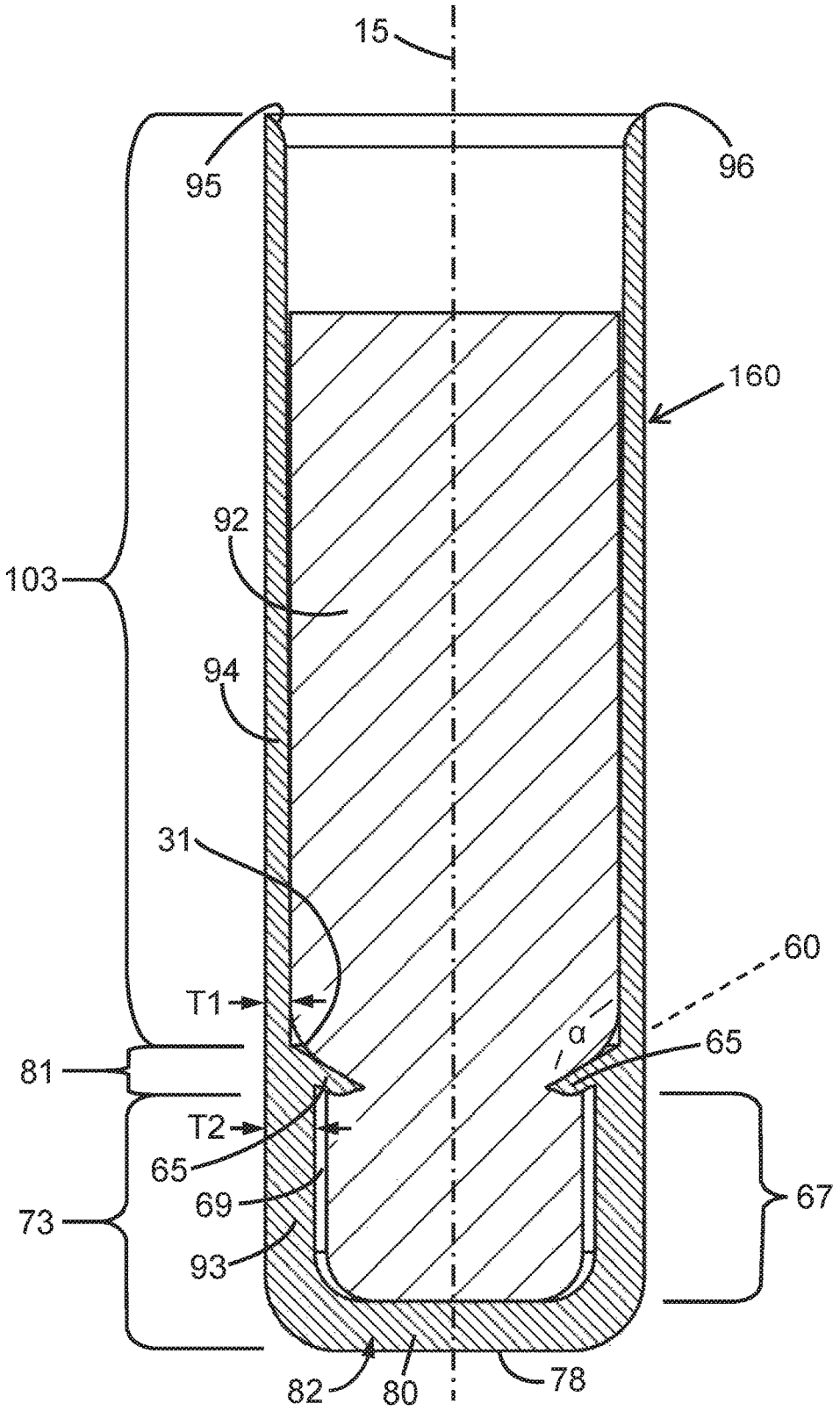
FIG. 20 is a longitudinal cross-sectional view of the processed cylindrical jacket and the core with a short leading end shown in FIG. 19 after the core has been partially seated in the jacket, in accordance with an embodiment of the present disclosure.

FIGS. 19 and 20 illustrate seating 425 the core 92 in the processed jacket 160 for projectiles having a core-locking angle α greater than 90 degrees. FIG. 19 shows the processed jacket 160 of FIG. 14 after core 92 configured with a shorter neck portion 36 has been dropped or placed 420 inside it with the shorter neck portion 36 and tapered end portion 39 passing through the centralized circular space defined between the core-locking protrusions 65. At this point, the core 92 is loosely held within the processed jacket 160 and the core shoulder 31 rests against the ends of the core-locking protrusions 65. A large annular gap 69 exists about the neck portion 36 and the tapered end portion 39 of the core 92. As shown in this embodiment, for example, the neck portion 36 shown here is considered to be "short." In some embodiments, this shorter neck length may be necessary in order to effectively bend the core-locking protrusions 65 to a locking angle α between 90 and 120 degrees during the core-seating process. In some embodiments, it is critical that a large amount of open space exists between base inside surface 70 of the jacket 82 and the core rear end 79. This additional open space facilitates even contact between the core shoulder 31 and the ends of the core-locking protrusions 65. Also, the open space delays the filling of the locking chamber 67 as core 92 material is extruded into it during seating 425 the core 92. While placing 420 the core 92 in the jacket pre-form 150, the core-locking protrusions 65 are disposed at a 30-degree angle or other angle consistent with blade angle β as initially formed with the dividing punch 130. This is the first step of seating 425 the core 92 for projectiles 100 having a core-locking angle α greater than 90 degrees in accordance with the present disclosure.

FIG. 20 shows the processed jacket 160 and core 92 of FIG. 19 after a flat-ended core seating punch (not shown) has begun to deform the core 92 and bend the core-locking protrusions 65 radially inward and rearward. As shown, axially-oriented forces have axially compressed and radially widened the core 92. During this shortening process, the core shoulder 31 was deformed as it pressed against the top surfaces of the core-locking protrusions 65 and bent them downwardly. Bending of the core-locking protrusions 65 occurs before a large amount of core 92 material is extruded through the spaces 66 in the rear sidewall 93 and before maximum deformation occurs in the smaller-diameter neck portion 36 of the core 92. In some embodiments, complete filling of the locking chamber 67 occurs after the core-locking protrusions 65 have been forced to extend along protrusion axis 60 to define final core-locking angle α. Essentially, the delayed extrusion and filling of the locking chamber 67 allows time for the core shoulder 31 to bend the core-locking protrusions 65. As can be seen, the annular gap 69 surrounding the now-deformed neck portion 36 has become narrower than that shown in FIG. 19 since the neck portion 36 has now grown in diameter. Even though the core 92 is only partially deformed at this point, it has already forced the core-locking protrusions 65 from their initial 30-degree angle to their final locking angle α of about 120 degrees while embedding the core-locking protrusions 65 in core 92. The final axial height 81 of the core-locking protrusions 65 is shown after the core-locking protrusions 65 have been forced radially inward during the initial step of seating 425 the core 92. While FIG. 20 shows only a partial seating 425 of the core 92, it illustrates the sequential progression involved in the second step in seating 425 the core 92 as discussed below with reference to FIG. 21.

Figure 21:
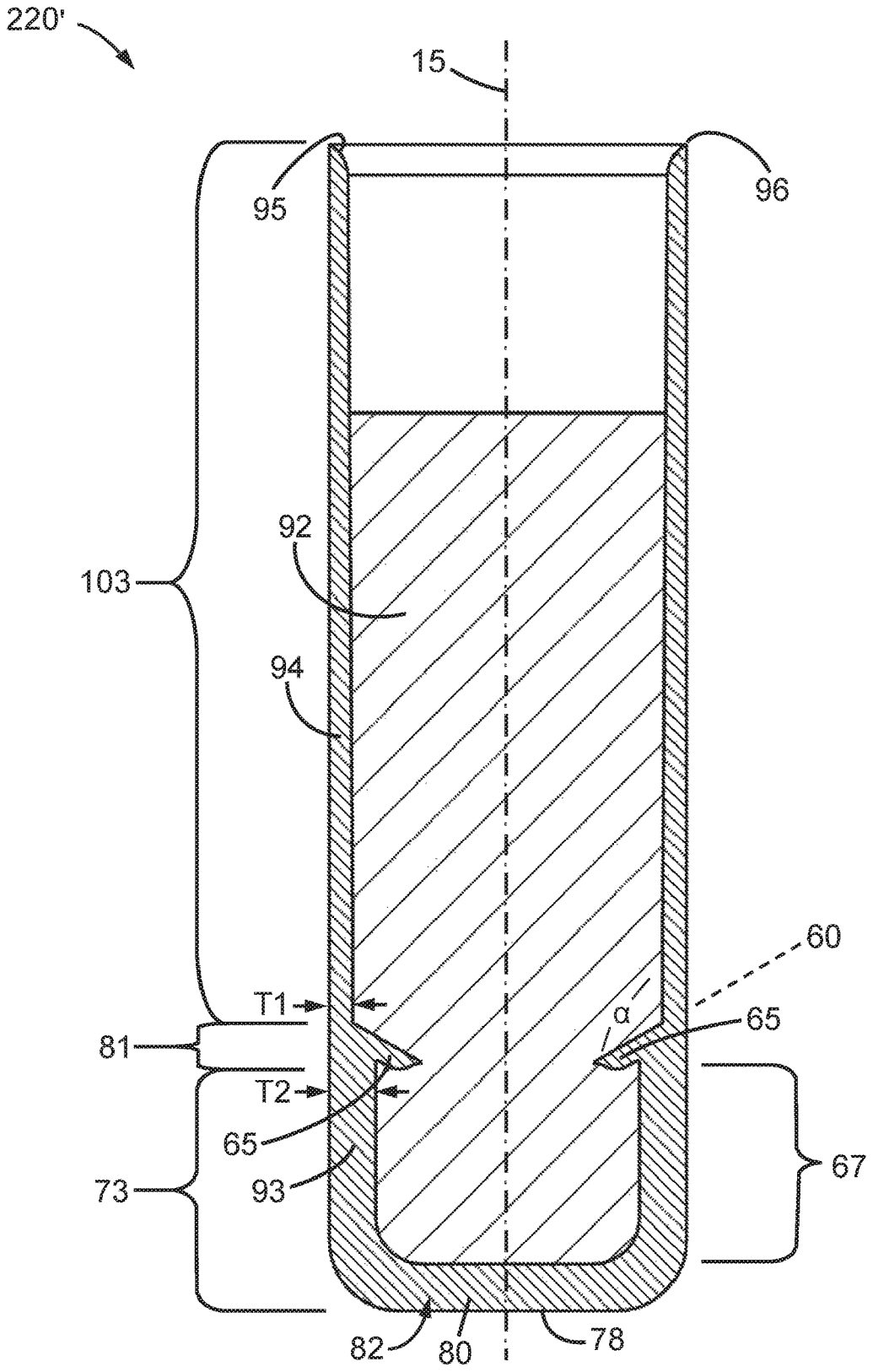
FIG. 21 is a longitudinal cross-sectional view of the processed cylindrical jacket and the core with a short leading end shown in FIG. 19 after the core has been fully seated in the jacket, thus forming a cylindrical pre-form, in accordance with an embodiment of the present disclosure.

FIG. 21 shows the processed jacket 160 and core 92 of FIG. 20 after the core 92 has been fully seated 425 in the processed jacket 160, resulting in cylindrical pre-form 220'. The core-seating punch (not shown) has further axially compressed and radially expanded the core 92 to completely fill the majority of the jacket 82, including the locking chamber 67, with core material 92. The annular gap 69 that existed around the deformed neck portion 36 of the core 92 in FIG. 20 has been completely displaced by core 92 material and core-locking protrusions 65 fully embedded into core 92. Core-locking protrusions 65 extend along protrusion axis 60 with a final locking angle α of about 120 degrees, which has been maintained due to a state of equilibrium achieved from the delay in filling the locking chamber 67 with core 92 material. Axial compression and radial expansion of the core 92 is the second step involved in the component-marrying process of seating 425 the core 92.

Figure 22:
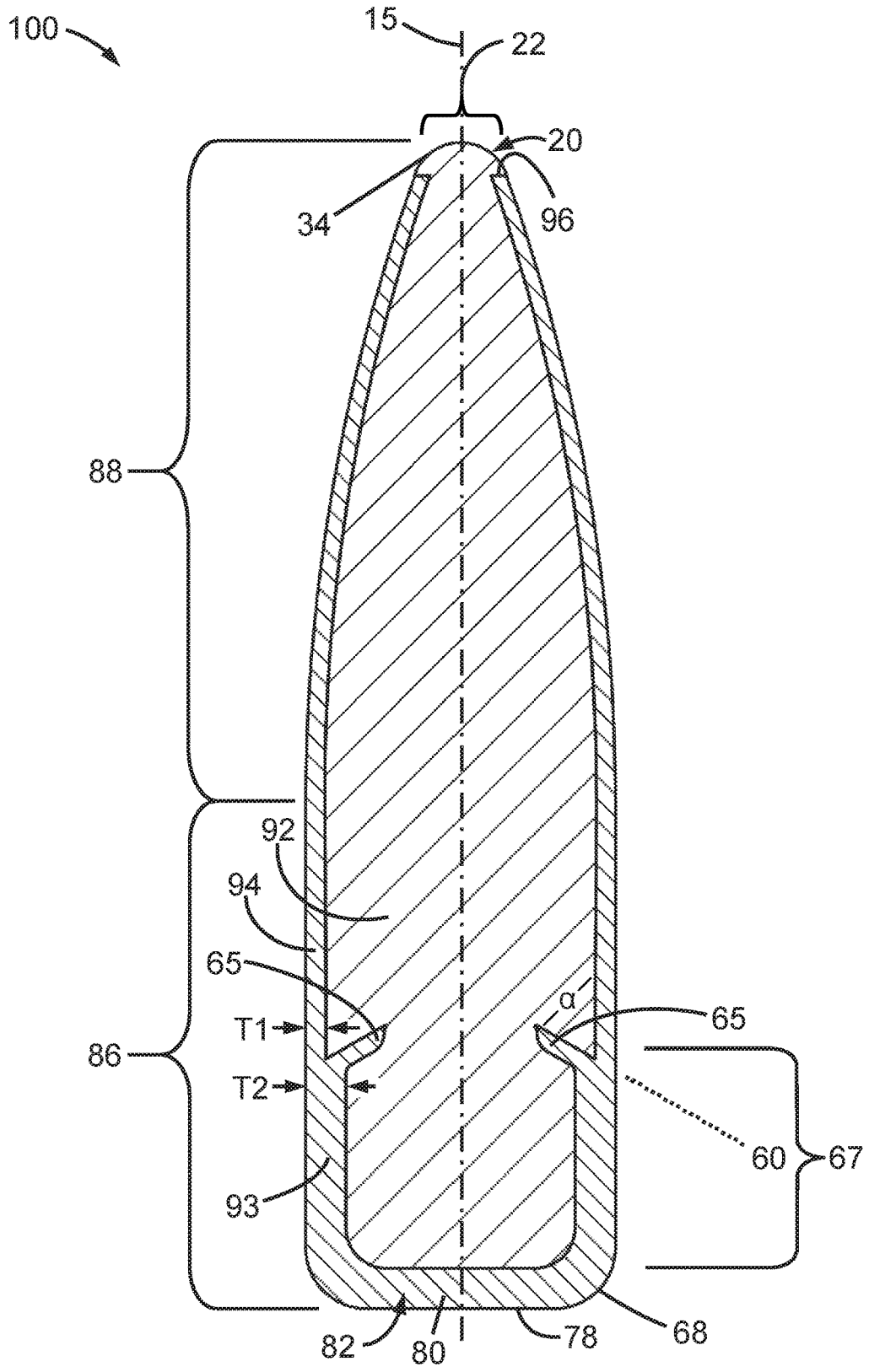
FIG. 22 is a longitudinal cross-sectional view of a profiled, fully-formed projectile made in accordance with a method of the present disclosure, where the core-locking protrusions in the cylindrical pre-form of FIG. 17 were pre-set at a 60-degree locking angle during the core-seating process with a core having a long leading end, and after the cylindrical pre-form was forced into an ogival die.

FIG. 22 illustrates a longitudinal cross-sectional view of an example of a profiled, fully-formed projectile 100 made in accordance with an embodiment of the present disclosure, where the core-locking protrusions 65 extend along protrusion axis 60 with a core-locking angle α of about 60 degrees. The core-locking angle α of 60 degrees was achieved (and pre-established in the cylindrical pre-form 220) through the use of a core 92 with a long neck portion 36 and that was fully seated 425 in the cylindrical pre-form 220 as shown for example in FIG. 17. The cylindrical pre-form 220 of FIG. 18 was then forced into an ogival pointing die to form 430 the projectile 100 as shown in FIG. 22.

Figure 23:
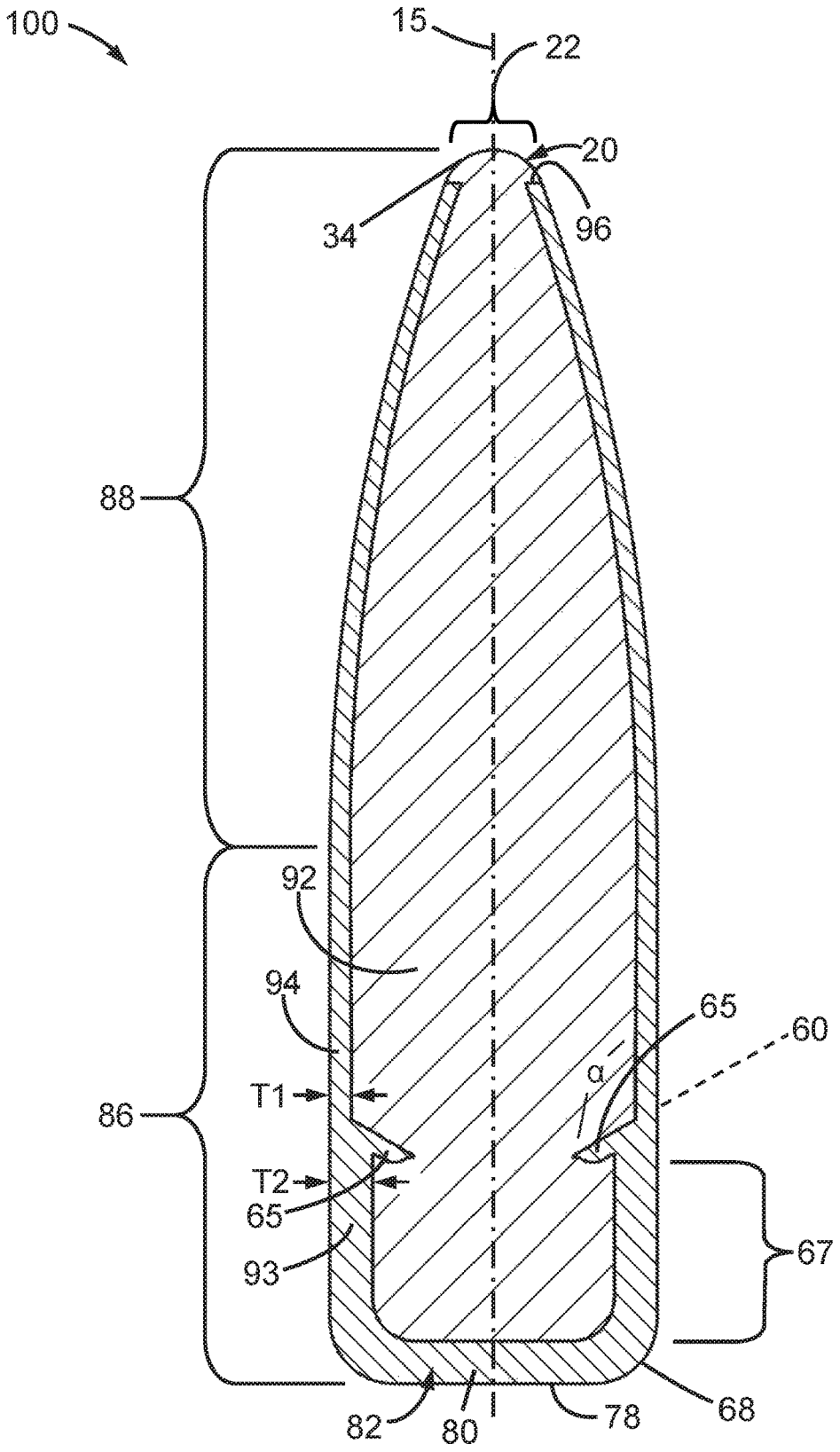
FIG. 23 is a longitudinal cross-sectional view of a profiled, fully-formed rifle projectile made in accordance with a method of the present disclosure, where the core-locking protrusions in the cylindrical pre-form of FIG. 20 were pre-set at a 120-degree locking angle during the core-seating process with a core having a short leading end, and after the pre-form was forced into an ogival die.

FIG. 23 illustrates a longitudinal cross-sectional view of an example of a profiled, fully-formed projectile 100 in accordance with an embodiment of the present disclosure, where the core-locking protrusions 65 extend along protrusion axis 60 to define a core-locking angle α of about 120 degrees. The core-locking angle α of 120 degrees was achieved (and pre-established in the cylindrical pre-form 220' of FIG. 20) through the use of a core 92 with a short neck portion 36 that was fully seated 425 in the cylindrical pre-form 220', such as shown in FIG. 21. The cylindrical pre-form 220' was then forced into an ogival pointing die to form 430 the projectile 100.

The use of a plurality of circumferentially-spaced core-locking protrusions 65 provides an improved grip on core 92 compared to prior-art methods due to increased protrusion into core 92 by each core-locking member 65. Core-locking protrusions 65 can be initially formed with a protrusion length as needed for core-locking protrusions 65 to embed into core 92 to the desired depth. The result is superior core-gripping ability that retains jacket 82 with core 92 on impact with a target.

Embodiments in accordance with the present disclosure provide an expanding projectile 100 with improved retention between the core 92 and the jacket 82 upon impact with a target. As a result, embodiments of projectile 100 have improved expansion to more effectively incapacitate a target in hunting, law enforcement, or self-defense situations. Expanding projectile 100 can be easily manufactured at low-cost in accordance with some embodiments of the present disclosure.

Figure 24:
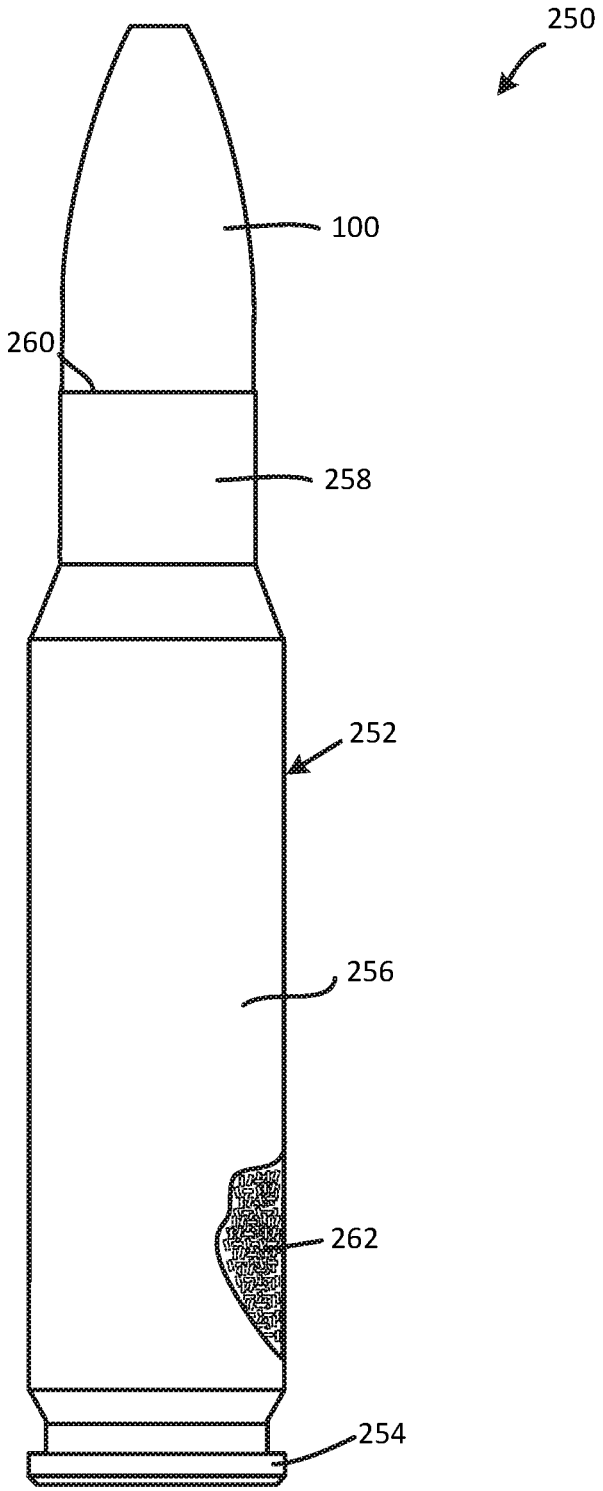
FIG. 24 is an elevational view of a firearm cartridge with a projectile retained in the mouth of the cartridge casing, in accordance with an embodiment of the present disclosure.

FIG. 24 illustrates an elevational view of a firearm cartridge 250 in accordance with an embodiment of the present disclosure. Cartridge 250 includes a cartridge casing 252 with a generally cylindrical shape. Cartridge casing 252 includes a head 254, a body 256, and a neck 258 that extends to an open mouth 260 with projectile 100 retained therein. In the embodiment shown in FIG. 24, neck 258 has a reduced diameter compared to body 256 as may be the case for rifle ammunition. A straight casing configuration can also be used. A quantity of propellant 262 (e.g., gunpowder) is contained within cartridge casing 252. As shown in FIG. 24, cartridge 250 is configured as a rifle cartridge with a hollow point projectile 100. Other ammunition types, casing configurations, and projectile configurations are acceptable, including pistol and rifle ammunition configured for rimfire or centerfire and having a projectile with a soft point, hollow point, and ballistic tip configurations. Numerous variations and embodiments will be apparent in light of the present disclosure.

The embodiments of the disclosure and the various features thereof are discussed with reference to the non-limiting embodiments and examples that are illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the disclosure. The examples used herein are intended merely to facilitate an understanding of ways in which the disclosure can be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings unless otherwise noted.

It is understood that the disclosure is not limited to the particular methodology, devices, apparatus, materials, applications, etc., described herein, as these may vary. It is also to be understood that the terminology used herein is used for the purpose of describing particular embodiments only, and is not intended to limit the scope of the disclosure. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this disclosure belongs. Example methods, structures, and materials are described, although any methods and materials similar or equivalent to those described herein can be used in the practice or testing of the disclosure.

Those skilled in the art will appreciate that many modifications to the embodiments are possible without departing from the scope of the disclosure. In addition, it is possible to use some of the features of the embodiments described without the corresponding use of the other features. Accordingly, the foregoing description of the exemplary embodiments is provided for the purpose of illustrating the principle of the disclosure, and not in limitation thereof, since the scope of the disclosure is defined solely by the appended claims.

What is claimed is:

1. A firearm projectile comprising:

a core extending along a central axis from a base portion to a tip portion, the base portion generally having a cylindrical shape and the tip portion comprising an ogive shape;

a jacket encasing the core along the base portion and the tip portion, the jacket having a shank portion defining a closed rear end and having an ogive portion extending to an open front end, the shank portion including a forward sidewall portion having a forward sidewall thickness and a rear sidewall portion having a rear sidewall thickness at least 1.5 times the forward sidewall thickness; and a plurality of protrusions extending into the core from an inside of the shank portion, each of the plurality of protrusions being continuous with the shank portion at an axial location between the forward sidewall portion and the rear sidewall portion, the plurality of protrusions having a circumferentially spaced-apart arrangement with each of the plurality of protrusions engaging the core to retain the core together with the jacket upon impact with a target.

2. The firearm projectile of claim 1, wherein the rear sidewall thickness is from 2.0 to 3.0 times the forward sidewall thickness.

3. The firearm projectile of claim 1, wherein the core comprises a first metal and the jacket comprises a second metal, the first material being more malleable than the second metal.

4. The firearm projectile of claim 1, wherein the core is made of a metal selected from the group consisting of lead, a lead alloy, a lead-antimony alloy, tin, and a tin alloy.

5. The firearm projectile of claim 4, wherein the metal is the lead-antimony alloy and wherein the lead-antimony alloy contains antimony in an amount from 0.25 percent to 6.0 percent by weight.

6. The firearm projectile of claim 4, wherein the metal is the tin alloy and the tin alloy contains tin in an amount from 90 percent to 99 percent by weight.

7. The firearm projectile of claim 1, wherein at least some of the plurality of protrusions have a circumferential width along the inside of the shank portion that is greater than a circumferential width of a gap between adjacent ones of the plurality of protrusions along the inside of the shank portion.

8. The firearm projectile of claim 1, wherein the plurality of protrusions includes a first protrusion positioned opposite the central axis from a second protrusion.

9. The firearm projectile of claim 1, wherein the plurality of protrusions includes at least three protrusions evenly distributed about the central axis.

10. The firearm projectile of claim 1, wherein each of the plurality of protrusions extends into the core along a protrusion axis defining a locking angle with an adjacent inside surface of the shank portion forward of the plurality of protrusions, the locking angle from 45° to 120°.

11. The firearm projectile of claim 10, wherein the locking angle is from 85° to 95°.

12. The firearm projectile of claim 10, wherein the locking angle is greater than 90°.

13. The firearm projectile of claim 1, wherein each of the plurality of protrusions extends into the core a distance from 0.015" to 0.100".

14. The firearm projectile of claim 1, wherein the ogive portion has a tangent ogive shape.

15. The firearm projectile of claim 1, wherein the ogive portion has a secant ogive shape.

16. The firearm projectile of claim 1, wherein the tip portion of the core protrudes from the open front end of the jacket and defines a rounded tip continuous with an outer surface of the jacket.

17. The firearm projectile of claim 1, wherein the tip portion of the core defines a cavity recessed from the open front end of the jacket.

18. The firearm projectile of claim 17 further comprising a tip insert having a tip shank portion extending axially into the cavity through the open front end of the jacket, and having a tip portion seated against the open front end.

19. The firearm projectile of claim 18, wherein the tip insert comprises a polymer.

20. The firearm projectile of claim 1, wherein the firearm projectile is an expanding projectile.

21. The firearm projectile of claim 1 further comprising a cartridge casing with a mouth, the projectile retained in the mouth of the cartridge casing.

* * * * *